US007991330B2

(12) United States Patent
Oshikawa et al.

(10) Patent No.: US 7,991,330 B2
(45) Date of Patent: Aug. 2, 2011

(54) DEVELOPING UNIT INCLUDING DEVELOPER CONVEYANCE SYSTEM HAVING SUPPLY PATH, RECOVERY PATH, AND AGITATION PATH, PROCESS CARTRIDGE INCLUDING DEVELOPING UNIT, AND IMAGE FORMING APPARATUS INCLUDING PROCESS CARTRIDGE

(75) Inventors: Yuki Oshikawa, Yamato (JP); Koichi Kato, Yokohama (JP); Hiroyuki Okaji, Yokohama (JP); Mugijirou Uno, Isehara (JP); Kiyonori Tsuda, Yokohama (JP); Emi Kita, Tokyo (JP); Keiko Matsumoto, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 429 days.

(21) Appl. No.: 12/187,015

(22) Filed: Aug. 6, 2008

(65) Prior Publication Data

US 2009/0041508 A1 Feb. 12, 2009

(30) Foreign Application Priority Data

Aug. 7, 2007 (JP) ..... 2007-205912
Jun. 30, 2008 (JP) ..... 2008-171495

(51) Int. Cl.
*G03G 15/08* (2006.01)

(52) U.S. Cl. ..... 399/254

(58) Field of Classification Search ..... 399/254, 399/27, 258

See application file for complete search history.

(56) References Cited

U.S. PATENT DOCUMENTS

| | | | | |
|---|---|---|---|---|
| 2007/0071502 | A1* | 3/2007 | Shimizu | 399/258 |
| 2007/0127951 | A1* | 6/2007 | Ishikawa et al. | 399/254 |
| 2007/0217798 | A1* | 9/2007 | Tsuji et al. | 399/27 |
| 2008/0124136 | A1 | 5/2008 | Oshikawa | |
| 2008/0175628 | A1 | 7/2008 | Kita et al. | |
| 2008/0181670 | A1 | 7/2008 | Tsuda et al. | |

FOREIGN PATENT DOCUMENTS

| | | |
|---|---|---|
| JP | 2000-98744 | 4/2000 |
| JP | 3264765 | 12/2001 |
| JP | 2005-292511 | 10/2005 |

OTHER PUBLICATIONS

Computer Translation of cited reference JP2005-292511A.*

* cited by examiner

*Primary Examiner* — Quana M Grainger
(74) *Attorney, Agent, or Firm* — Oblon, Spivak, McClelland, Maier & Neustadt, L.L.P.

(57) ABSTRACT

A developing unit includes a developer bearing member, a developer transporter, a developer conveyance system for directing the developer, including a supply path, a recovery path, and an agitation path, a developer supply opening through which the developer is supplied to the developer conveyance system, a developer supply device for supplying the developer from the developer supply opening to the developer conveyance system, a developer discharge device for discharging the developer outside the developing unit, a developer level rise detector for detecting increase in a level of the developer between the downstream end of the recovery path facing the developer bearing member in the direction of developer transport and a portion of the agitation path where the agitation path receives the collected developer from the recovery path, and a controller for controlling the developer discharge device based on the detection result provided by the developer level rise detector.

15 Claims, 14 Drawing Sheets

DEVELOPING UNIT INCLUDING DEVELOPER CONVEYANCE SYSTEM HAVING SUPPLY PATH, RECOVERY PATH, AND AGITATION PATH, PROCESS CARTRIDGE INCLUDING DEVELOPING UNIT, AND IMAGE FORMING APPARATUS INCLUDING PROCESS CARTRIDGE

CROSS-REFERENCE TO RELATED APPLICATIONS

This patent application is based on and claims priority pursuant to 35 U.S.C. §119 from Japanese Patent Applications No. 2007-205912 filed on Aug. 7, 2007 and No. 2008-171495 filed on Jun. 30, 2008 in the Japan Patent Office, the entire contents of each of which are hereby incorporated herein by reference.

BACKGROUND OF THE INVENTION

1. Field of the Invention

Exemplary aspects of the present invention generally relate to a developing unit, a process cartridge including the developing unit, and an image forming apparatus including the process cartridge.

2. Description of the Background Art

Conventionally, image forming apparatuses equipped with a developing unit using a two-component developer including a toner and a magnetic carrier have been widely used. Among image forming apparatuses of this kind, there is known a type that maintains toner density of the developer in a certain range by supplying the toner from a toner cartridge to the developer in the developing unit from which the toner is consumed during development.

In such a configuration, it is likely that the carrier in the developer is barely consumed but repeatedly reused, thereby wearing out a coating layer of a surface of the carrier and/or attracting a toner resin and additives to the coating layer as an image is output. Consequently, charging characteristics of the carrier for charging the toner may deteriorate gradually. Namely, the carrier may be degraded.

When such degradation of the carrier progresses, electric charge of the toner is reduced, causing background contamination and/or toner dispersion. Thus, such an image forming apparatus requires periodic replacement of the carrier by a maintenance personnel, resulting in an increase in maintenance cost and unit price.

Japanese Patent Unexamined Application Publication No. 2005-292511 discloses a developing unit in which a premixed developer including a carrier and a toner is supplied to the developer in the developing unit so as to recover the toner density, while the amount by which the developer is increased is discharged outside the developing unit.

A new carrier in the premixed developer is supplied to the developer in the developing unit, while an old carrier is discharged from the developing unit little by little by discharging the developer. Accordingly, the carrier in the developer is replaced with the new carrier, thereby making it possible to replace the carrier easily.

In addition, the developer according to Japanese Patent Unexamined Application Publication No. 2005-292511 includes a developer discharge vent at a position where the level of the developer rises and falls depending on the amount of the developer added and reduced in a developer conveyance path.

In such related art developing unit, when the premixed developer is supplied, thereby increasing the total amount of the developer in the developing unit, the level of the developer in a developer supply conveyance path rises. When the level of the developer reaches the height of the developer discharge vent, the developer is discharged outside the developing unit from the developer discharge vent.

Japanese Patent No. 3264765 discloses a developing unit including a shutter serving as a developer discharging mechanism that opens and closes the developer discharge vent. When the toner density decreases and thus the premixed developer is supplied, accordingly the shutter is simultaneously opened to allow the developer to be discharged from the developer discharge vent.

In this developing unit, based on the toner density, the size of the opening of the developer discharge vent is regulated by the shutter such that a predetermined amount of the developer is discharged.

However, in the related art developing unit disclosed in Japanese Patent Unexamined Application Publication 2005-292511, the traveling speed of the developer being transported in the developer conveyance path and/or the torque of a developer conveyance screw serving as a developer transporter, which exerts a conveyance force on the developer, may cause the developer to leap, causing the excess developer to be discharged inadvertently from the developer discharge vent even when the amount of the developer in the developing unit is not increased.

When the developing unit has such a structure allowing the excess developer to be discharged outside even when the amount of the developer transported in the developer conveyance path is appropriate and/or the amount of the developer falls below the appropriate amount, the appropriate amount of the developer in the developing unit cannot be reliably maintained. In other words, despite the fact that the amount of the developer in the developing unit is not increased, there is a possibility that the developer may still be discharged inadvertently.

When the developer is discharged from the developer discharge vent regardless of the fact that the amount of the developer is less than the appropriate amount, the amount of the developer in the developing unit falls below the necessary amount of the developer in the developing unit. As a result, the developer is inadequately supplied to the developer bearing member, and thus a desirable image density may not be obtained.

By contrast, according to the related art developing unit having the shutter disclosed in Japanese Patent No. 3264765, the shutter is opened only when the premixed developer is supplied, allowing the developer to be discharged from the developer discharge vent. Accordingly, it is made possible to suppress inadvertent discharge of the excess developer caused by the torque of the developer conveyance screw or the like, so that the developer in the developing unit is maintained at an appropriate level.

However, according to this configuration, the amount of the developer to be discharged is regulated based on the toner density. In other words, the amount of the developer to be discharged is not regulated based on the amount of the developer in the developing unit. Thus, there is a possibility that when fluidity of the developer is reduced due to degradation of the developer and/or fluctuation in ambient conditions, it is difficult to smoothly discharge the developer from the developer conveyance path to the developer discharge vent.

Consequently, when the shutter is opened to discharge the developer, there is a possibility that a predetermined amount of the developer is not discharged from the developer discharge vent, thereby increasing the amount of the developer in the developer conveyance path more than necessary. As a result, there is a problem in that the developer is accumulated and overflows from the developing unit.

SUMMARY OF THE INVENTION

In view of the foregoing, exemplary embodiments of the present invention provide a developing unit including a developer bearing member, a developer transporter, a developer conveyance system for directing the developer along an axial direction of the developer bearing member and supplying the developer to the developer bearing member, a developer supply opening, a developer supply device, a developer discharge device, a developer level rise detector, and a controller. The developer bearing member is provided across from a latent image bearing member including a latent image on a surface thereof and configured to bear a developer on the surface of the developer bearing member and supply a toner to the latent image on the surface of the latent image bearing member while rotating. The developer transporter is configured to convey the developer. The developer conveyance system includes a supply path, a recovery path, and an agitation path. The supply path is configured to direct the developer along a shaft direction of the developer bearing member and supply the developer to the developer bearing member. The recovery path is configured to direct the developer collected from the developer bearing member along the shaft direction of the developer bearing member after passing an area opposite to the latent image carrier and in substantially the same direction as the transporting direction of the supply path. The agitation path is configured to receive an excess developer not used during development and transported to the vicinity of a downstream end of the supply path in the direction of developer transport, and a collected developer transported to the vicinity of the downstream end of the recovery path in the direction of developer transport, direct the excess developer and the collected developer along the shaft direction of the developer bearing member and in an opposite direction as that of the supply path while mixing the excess developer and the collected developer, and supply a mixed developer to the supply path after mixing the excess developer and the collected developer. The developer supply opening allows the developer to be supplied to the developer conveyance system therethrough. The developer supply device is configured to supply the developer from the developer supply opening to the developer conveyance system. The developer discharge device is configured to discharge the developer outside the developing unit. The developer level rise detector is configured to detect rise of a level of the developer between the downstream end of the recovery path facing the developer bearing member in the direction of developer transport and a portion of the agitation path where the agitation path receives the collected developer from the recovery path. The controller is configured to control the developer discharge device based on the detection result provided by the developer level rise detector.

In one exemplary embodiment, a developing unit includes a developer bearing member, a developer transporter, a developer conveyance system for directing the developer along a shaft direction of the developer bearing member and supplying the developer to the developer bearing member, a developer supply opening, a developer supply device, a developer discharge device, a developer level decrease detector, and a controller. The developer bearing member is provided across from a latent image bearing member including a latent image on a surface thereof and configured to bear a developer on the surface of the developer bearing member and supply a toner to the latent image on the surface of the latent image bearing member while rotating. The developer transporter is configured to convey the developer. The developer conveyance system includes a supply path, a recovery path, and an agitation path. The supply path is configured to direct the developer along a shaft direction of the developer bearing member and supply the developer to the developer bearing member. The recovery path is configured to direct the developer collected from the developer bearing member along the shaft direction of the developer bearing member after passing an area opposite to the latent image carrier and in substantially the same direction as the transporting direction of the supply path. The agitation path is configured to receive an excess developer not used during development and transported to the vicinity of a downstream end of the supply path in the direction of developer transport and a collected developer transported to the vicinity of the downstream end of the recovery path in the direction of developer transport, direct the excess developer and the collected developer along the shaft direction of the developer bearing member and in an opposite direction as that of the supply path while mixing the excess developer and the collected developer, and supply a mixed developer to the supply path after mixing the excess developer and the collected developer. The developer supply opening allows the developer to be supplied to the developer conveyance system therethrough. The developer supply device is configured to supply the developer from the developer supply opening to the developer conveyance system. The developer discharge device is configured to discharge the developer outside the developing unit. The developer level decrease detector is configured to detect decrease in a level of the developer in a vicinity of the downstream end of the supply path facing the developer bearing member in the direction of developer transport. The controller is configured to control the developer supply device based on the detection result provided by the developer level decrease detector.

Another exemplary embodiment provides an image forming apparatus including an image bearing member configured to bear a latent image on a surface thereof and the developing unit.

Additional features and advantages of the present invention will be more fully apparent from the following detailed description of exemplary embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of exemplary embodiments when considered in connection with the accompanying drawings, wherein.

DETAILED DESCRIPTION OF EXEMPLARY EMBODIMENTS

Figure 1:
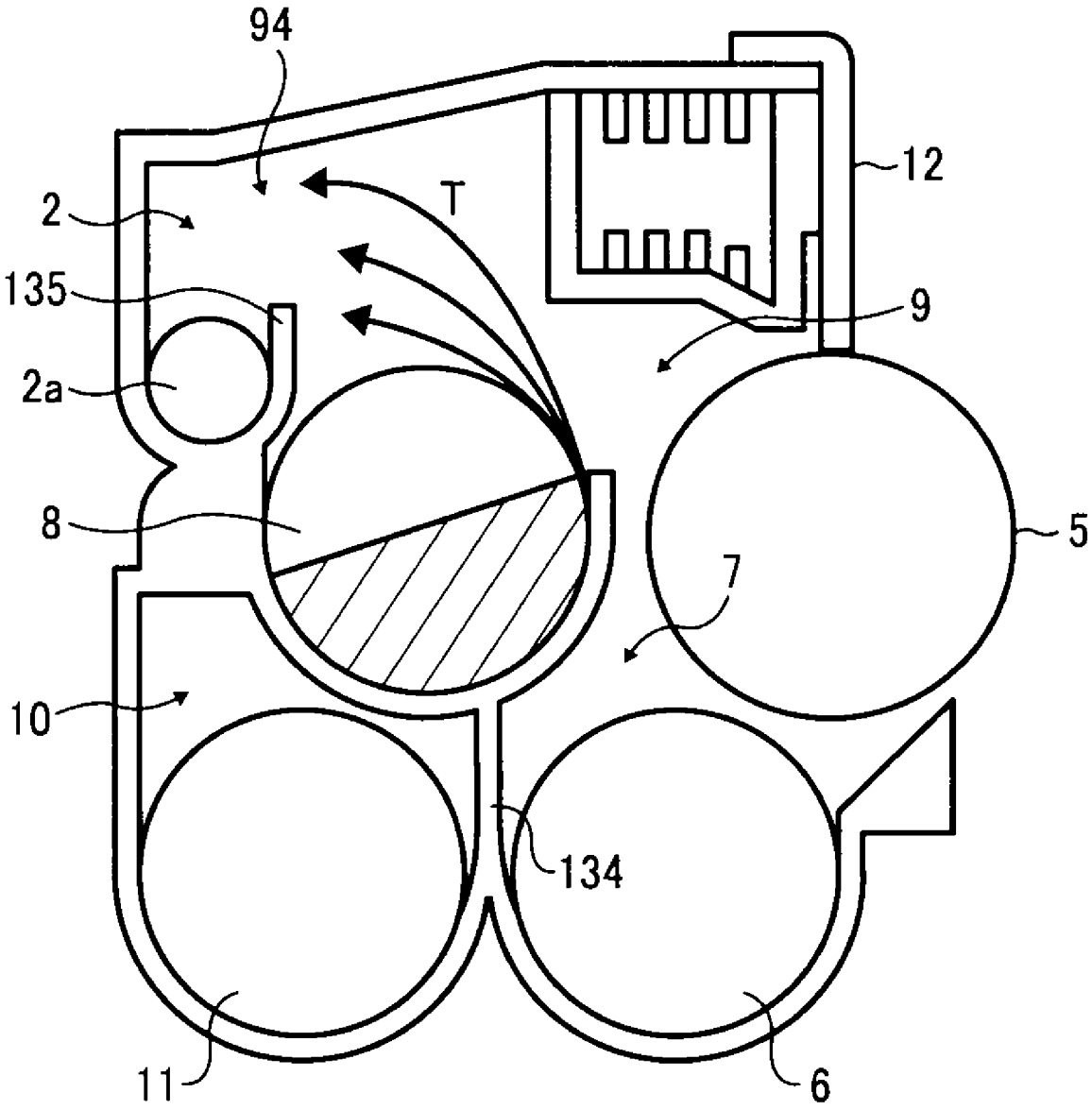
FIG. 1 is a schematic diagram illustrating a developing unit, according to an exemplary embodiment of the present invention.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Exemplary embodiments of the present invention are now described below with reference to the accompanying drawings.

In a later-described comparative example, exemplary embodiment, and alternative example, for the sake of simplicity of drawings and descriptions, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially to FIG. 2, a tandem-type color laser copier (hereinafter simply referred to as a copier) as one example of an image forming apparatus, in which a plurality of photoreceptors 1 is aligned next to each other, according to an exemplary embodiment of the present invention, is described.

Figure 2:
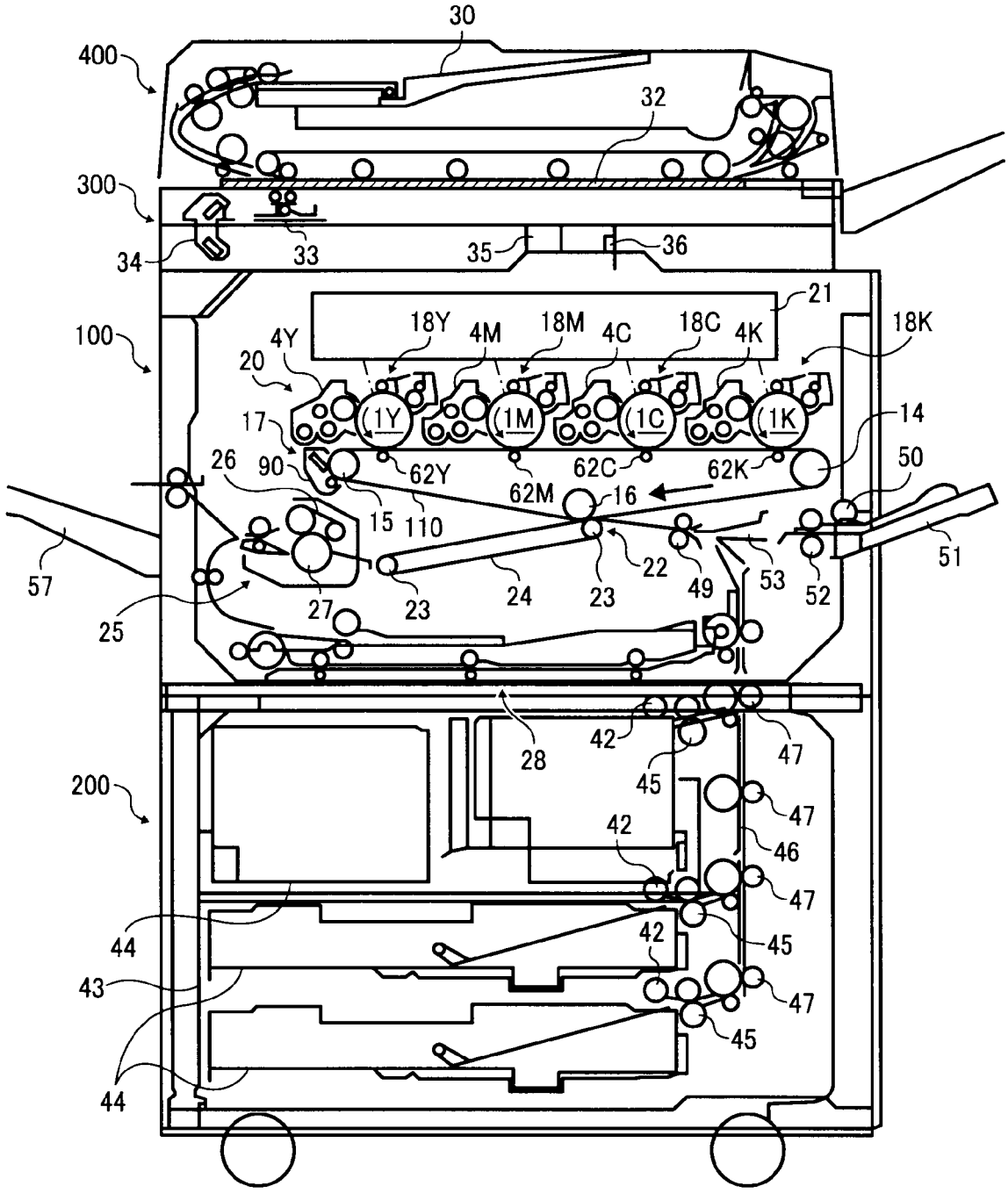
FIG. 2 is a schematic diagram illustrating a copier as an example of an image forming apparatus, according to an exemplary embodiment of the present invention.

FIG. 2 is a schematic diagram illustrating the image forming apparatus, for example, the copier, according to the exemplary embodiment. The image forming apparatus includes at least a printer unit 100, a sheet feed unit 200 on which the printer unit 100 is disposed, a scanner 300 fixedly provided on the printer unit 100, an automatic document feeder (ADF) 400 fixedly provided on the scanner 300, and so forth.

In FIG. 2, the printer unit 100 includes an image forming unit 20 equipped with four process cartridges 18Y, 18M, 18C, and 18K for forming images of yellow (Y), magenta (M), cyan (C), and black (K), respectively. Further, the printer unit 100 includes an optical writing unit 21, an intermediate transfer unit 17, a secondary transfer unit 22, a pair of registration rollers 49, a fixing unit 25 using a fixing belt, and so forth.

It is to be noted that, thereafter, reference characters Y, M, C, and K denote colors of yellow, magenta, cyan, and black, respectively.

The optical writing unit 21 includes a light source, not shown, a polygon mirror, an f-θ lens, a reflective mirror, and so forth, and irradiates the surface of a later-described photoreceptor 1 with a laser beam based on image data.

The process cartridges 18Y, 18M, 18C, and 18K each include the drum-type photoreceptor 1, a charging unit, a developing unit 4, a drum cleaning unit, a charge eliminator, and so forth. The process cartridges 18Y, 18M, 18C, and 18K are detachable from the image forming apparatus.

A description will be now given of the process cartridge 18Y for yellow as a representative example of the process cartridges 18Y through 18K.

The charging unit serving as a charging mechanism uniformly charges the surface of the photoreceptor 1Y. The laser beam, which is modulated and deflected in the optical writing unit, is directed onto the surface of the charged photoreceptor 1Y. Accordingly, the potential of a portion of the irradiated or exposed surface attenuates. Due to attenuation, an electrostatic latent image for yellow is formed on the surface of the photoreceptor 1Y.

The electrostatic latent image Y formed thereon is developed by the developing unit 4 serving as a developing mechanism, thereby forming a toner image of yellow. The toner image Y formed on the photoreceptor 1Y is primarily transferred onto a later-described intermediate transfer belt 110. After the primary transfer, a residual toner remaining on the surface of the photoreceptor 1Y is cleaned by the drum cleaning unit.

In the process cartridge 18Y, the photoreceptor 1Y cleaned by the drum cleaning unit is discharged by the charge eliminator. Subsequently, the photoreceptor 1Y is uniformly charged by the charging unit and returns to an initial state. The similar image forming sequence as described above is performed by other process cartridges 18M, 18C, and 18K.

Next, a description will be given of the intermediate transfer unit 17. The intermediate transfer unit 17 includes the intermediate transfer belt 110, a belt cleaning unit 90, a tension roller 14, a driving roller 15, a secondary transfer backup roller 16, four primary transfer bias rollers 62Y, 62M, 62C, and 62K, and so forth.

The intermediate transfer belt 110 is wound around and stretched by a plurality of rollers including the tension roller 14. The driving roller 15 is driven to rotate by the belt driving motor, not shown, and moves the intermediate transfer belt 110 endlessly in the clockwise direction indicated by an arrow in FIG. 2.

The four primary transfer bias rollers 62Y, 62M, 62C, and 62K are aligned such that each of the primary transfer bias rollers 62Y, 62M, 62C, and 62K contacts a surface of an inner loop of the intermediate transfer belt 110, and is supplied with a primary transfer bias by a power source, not shown.

Each of the four primary transfer bias rollers 62Y, 62M, 62C, and 62K presses the intermediate transfer belt 110 against the photoreceptors 1Y, 1M, 1C, and 1K, thereby forming primary transfer nips therebetween. In each of the primary transfer nips between the photoreceptors 1Y, 1M, 1C, and 1K, and the primary transfer bias rollers 62Y, 62M, 62C, and 62K, a primary transfer electric field is formed due to the primary transfer bias.

The toner image Y formed on the photoreceptor 1Y is primarily transferred onto the intermediate transfer belt 110 by the primary transfer electric field and the nip pressure. Toner images M, C, and K formed on the photoreceptors 1M, 1C, and 1K, respectively, are primarily overlappingly transferred onto the toner image Y on the intermediate transfer belt 110. Accordingly, a multi-color toner image, that is, a four-color toner image is formed on the intermediate transfer belt 110.

The four-color toner image formed on the intermediate transfer belt 110 is secondarily transferred onto a recording medium, such as a paper sheet or the like, at a secondary transfer nip described later.

After the recording medium passes through the secondary transfer nip, the residual toner remaining on the surface of the intermediate transfer belt 110 is cleaned by the belt cleaning unit 90 which sandwiches the intermediate transfer belt with the driving roller 15.

Next, a description will be given of the secondary transfer unit 22. The secondary transfer unit 22 is disposed substantially below the intermediate transfer unit 17 illustrated in FIG. 2. In the secondary transfer unit 22, a sheet conveyance belt 24 is wound around and spanned by two tension rollers 23. Rotation of one of the tension rollers 23 causes the sheet conveyance belt 24 to move endlessly in a counter-clockwise direction in FIG. 2.

One of the tension rollers 23 disposed on the right side and the secondary transfer backup roller 16 nip the intermediate transfer belt 110 and the sheet conveyance belt 24, thereby forming a secondary transfer nip in which the intermediate transfer belt 110 of the intermediate transfer unit 17 contacts the sheet conveyance belt 24 of the secondary transfer unit 22.

The other tension roller 23 is supplied with the secondary transfer bias of an opposite polarity of toner by a power source, not shown. When the secondary transfer bias is supplied, the secondary transfer electric field is formed in the secondary transfer nip. The secondary transfer electric field causes the four-color toner image on the intermediate transfer belt 110 of the intermediate transfer unit 17 to electrostatically move to the other tension roller 23.

The recording sheet is sent to the secondary transfer nip by the pair of the registration rollers 49 in appropriate timing such that the recording sheet is aligned with the four-color toner image formed on the intermediate transfer belt 110. Due to the secondary transfer electric field and the nip pressure, the four-color toner image is secondarily transferred onto the recording sheet.

Alternatively, a charger which charges the recording sheet in a non-contact manner may be implemented instead of the secondary transfer method in which one of the tension rollers 23 is supplied with the secondary transfer bias.

The sheet feed unit 200 provided substantially below the image forming apparatus includes a plurality of sheet feed cassettes 44 provided one on top of another in a vertical direction. Each of the plurality of the sheet feed cassettes 44 stores a plurality of recording sheets, such as paper sheets. A sheet feed roller 42 is pressed against a top sheet of the recording sheets in each of the plurality of the sheet feed cassettes 44. When the sheet feed roller 42 is driven to rotate, the top sheet is sent to a sheet feed path 46.

The sheet feed path 46 includes a plurality of conveyance roller pairs 47 and the pair of the registration rollers 49 that is provided in the vicinity of the end of the path. The recording sheet is transported to the pair of the registration rollers 49 in the sheet feed path 46. Subsequently, the recording sheet transported to the pair of the registration rollers 49 is nipped therebetween.

In the intermediate transfer unit 17, the four-color toner image formed on the intermediate transfer belt 110 advances to the secondary transfer nip as the intermediate transfer belt 110 moves. The pair of the registration rollers 49 sends out the recording sheet nipped therebetween in appropriate timing such that the recording sheet contacts closely the four-color toner image in the secondary transfer nip.

Accordingly, in the secondary transfer nip, the four-color toner image on the intermediate transfer belt 110 contacts the recording sheet and is transferred onto the recording sheet forming a full-color image.

Subsequently, the recording sheet, on which the full-color image is formed, exits the secondary transfer nip along with the endless movement of the sheet conveyance belt 24 and is sent to the fixing unit 25 while being carried on the sheet conveyance belt 24.

The fixing unit 25 includes a belt unit in which a fixing belt 26 is stretched by two rollers and endlessly movable, and a pressure roller 27 pressed against one of the rollers of the belt unit. The fixing belt 26 and the pressure roller 27 contact each other forming a fixing nip by which the recording sheet sent from the sheet conveyance belt 24 is nipped.

One of the two rollers of the belt unit pressed by the pressure roller 27 includes a heat source inside thereof, not shown, thereby heating the fixing belt 26. When the fixing belt 26 is heated, the recording sheet nipped in the fixing nip is heated as well. The full-color image is fixed onto the recording sheet due to the heat and the nip pressure.

After the fixing process is performed on the recording sheet in the fixing unit 25, the recording sheet is stacked on a catch tray 57 provided on the left side wall outside the image forming apparatus, or returned to the secondary transfer nip to form a toner image on the other side of the recording sheet.

When copying a document consisting of a plurality of sheets, the sheaf of the document sheets is placed on a document table 30 of the ADF 400. Alternatively, when copying a document bound in a book-like manner, that is, the document is bound at one side thereof, the document is placed on a contact glass 32. When placing the document on the contact glass 32, the ADF 400 is opened relative to the main body of the image forming apparatus, thereby exposing the contact glass 32 of the scanner 300. After placing the document on the contact glass 32, the ADF is closed, thereby holding the document.

When a copy-start button, not shown, is depressed after the document is set as described above, the scanner 300 is enabled to read the document. Alternatively, when the document is placed on the ADF 400, the document is automatically transported to the contact glass 32 by the ADF 400.

When reading the document, a first carriage 33 and a second carriage 34 are enabled to travel. A light source provided to the first carriage 33 emits light. Subsequently, the light reflected from the document surface is reflected by a mirror provided in the second carriage 34, passes an imaging lens 35, and enters a reading sensor 36. The reading sensor 36 establishes image information based on the incident light.

In parallel with the document reading operation, operations of each component in the process cartridges 18Y, 18M, 18C, and 18K, the intermediate transfer unit 17, the secondary transfer unit 22, and the fixing unit 25 are initiated.

Subsequently, based on the image information established by the reading sensor 36, an operation of the optical writing unit 21 is controlled such that the toner images of yellow, magenta, cyan, and black are formed on the respective photoreceptors 1Y, 1M, 1C, and 1K. These toner images are overlappingly transferred onto the intermediate transfer belt 110, thereby forming a four-color composite toner image.

Substantially at the same time when the document reading operation is initiated, a sheet feeding operation is initiated in the sheet feed unit 200. When feeding the recording sheet, one of the sheet feed rollers 42 is selected and rotated to feed the recording sheet from one of the sheet feed cassettes 44 in the paper bank 43.

The recording sheets fed from the sheet feed cassette 44 are separated one by one by the separation roller 45, advances the sheet feed path 46, and are transported to the secondary transfer nip by the pair of the sheet conveyance rollers 47.

Alternatively, the recording sheet may be fed from a manual sheet feed tray 51, instead of feeding the recording sheet from the sheet feed cassette 44. In this case, a manual feed roller 50 is selected to rotate and feeds the recording sheet onto the manual sheet feed tray 51. Subsequently, a separation roller 52 separates the recording sheets one by one and feeds the recording sheet to a manual sheet feed path 53 in the printer unit 100.

In the image forming apparatus according to the exemplary embodiment, when forming a color image using more than two colors of toners, the intermediate transfer belt 110 is stretchedly held such that the upper portion of the spanned surface is relatively horizontal and contacts all the photoreceptors 1Y, 1M, 1C, and 1K.

In a case in which a monochrome image using a black toner is formed, the intermediate transfer belt 110 is held by a device, not shown, in a manner relatively slanting toward the lower left in FIG. 2. The upper portion of the spanned surface is separated from the photoreceptors 1Y, 1M, and 1C. The photoreceptor 1K for black is rotated counterclockwise, thereby forming a black toner image thereon.

At this time, not only operations of the photoreceptors 1Y, 1M, and 1C, but also operations of the developing units 4Y, 4M, and 4C for yellow, magenta, and cyan is halted so that unnecessary operations of the photoreceptors and consumption of developer can be prevented.

The image forming apparatus according to the exemplary embodiment includes a control unit and an operation display unit, not shown. The control unit includes a CPU or the like which controls components in the image forming apparatus. The operation display unit includes a liquid crystal display, various keybuttons, and so forth.

With respect to a single-side printing mode in which an image is formed on one side of the recording sheet, an operator may select one of three modes described later by operating the keybuttons on the operation display unit so as to instruct the control unit.

The three modes include a direct-discharge mode, a reverse-discharge mode, and a reverse-decare discharge mode.

Figure 3:
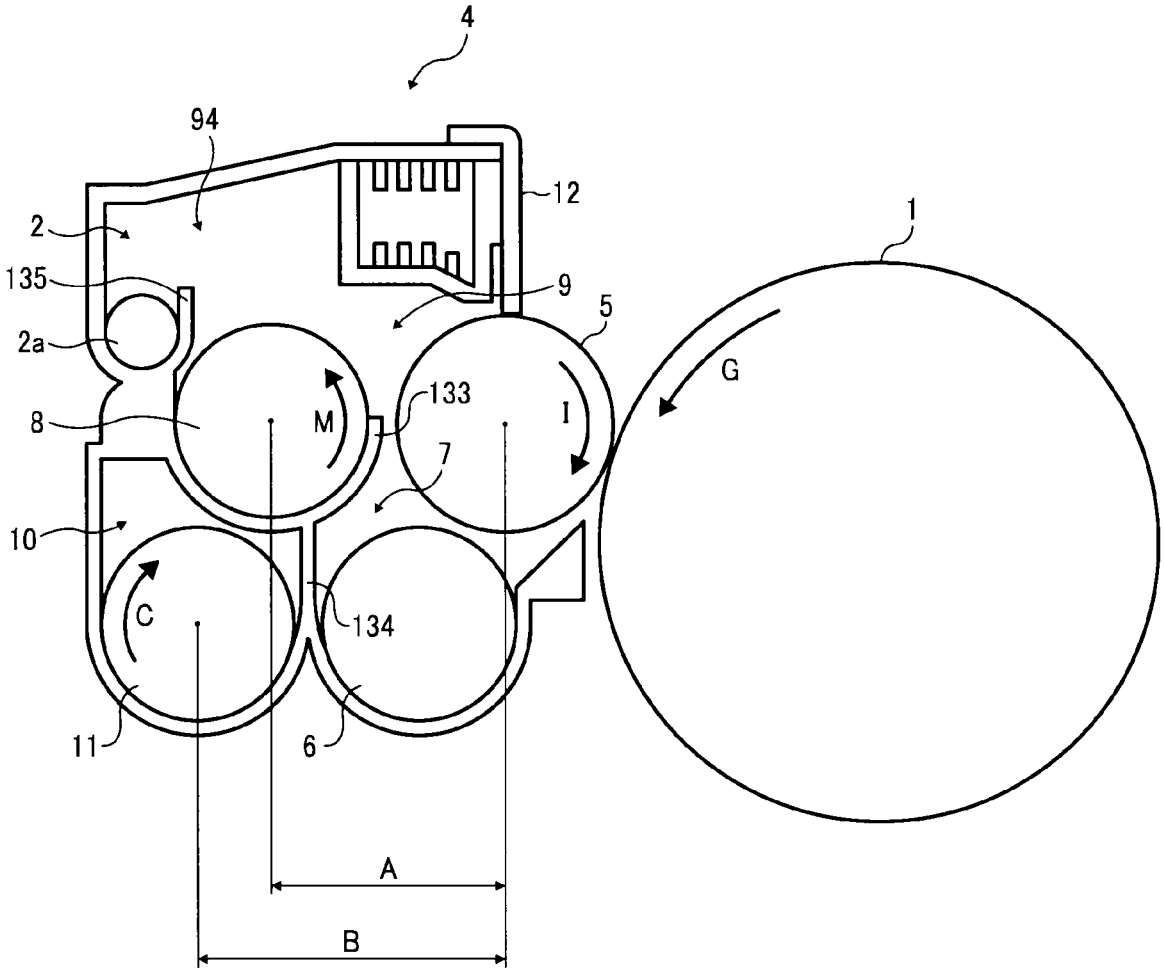
FIG. 3 is a schematic diagram illustrating the developing unit of FIG. 1 and a photoreceptor, according to an exemplary embodiment of the present invention.

Referring now to FIG. 3, as a representative example there is provided an enlarged schematic diagram illustrating the developing unit 4 and the photoreceptor 1 of one of the four process cartridges 18Y, 18M, 18C, and 18K. The four process cartridges 18Y, 18M, 18C, and 18K have the same configuration, except for the color of toner employed. Therefore, to simplify the description, the reference characters Y, M, C, and K indicating colors are omitted herein.

As illustrated in FIG. 3, while the photoreceptor 1 rotates in a direction indicated by arrow G, the surface thereof is charged by the charging unit, not shown. The charged surface of the photoreceptor 1 is illuminated by the exposure unit, not shown, so that an electrostatic latent image is formed on the photoreceptor surface. The latent image is supplied with a toner from the developing unit 4, thereby forming a toner image.

The developing unit 4 includes a developing roller 5 and a supply screw 8. The developing roller 5 serves as a developer bearing member that supplies the toner to the latent image on the surface of the photoreceptor, thereby developing the latent image into a visible image, while rotating in a direction indicated by arrow I.

The supply screw 8 serves as a developer transporter and transports the developer in a frontward direction in FIG. 3, while supplying the developer to the developing roller 5. The supply screw 8 includes a rotary shaft and a paddle portion that is provided to the rotary shaft. When the supply screw 8 rotates, the developer is transported in the shaft direction thereof.

A doctor blade 12 is provided downstream from the developing roller 5 facing the supply screw 8 in the direction of movement of the surface of the developing roller 5. The doctor blade 12 serves as a developer regulating member configured to regulate a thickness of a layer of the developer supplied to the developing roller 5 to a suitable thickness for development.

Downstream from the developing portion where the developing roller 5 faces the photoreceptor 1, the recovery screw 6 is provided to collect the developer used in development and passed through the developing portion, and to transport the collected developer in the same direction as the direction of movement of the supply screw 8.

Figure 4:
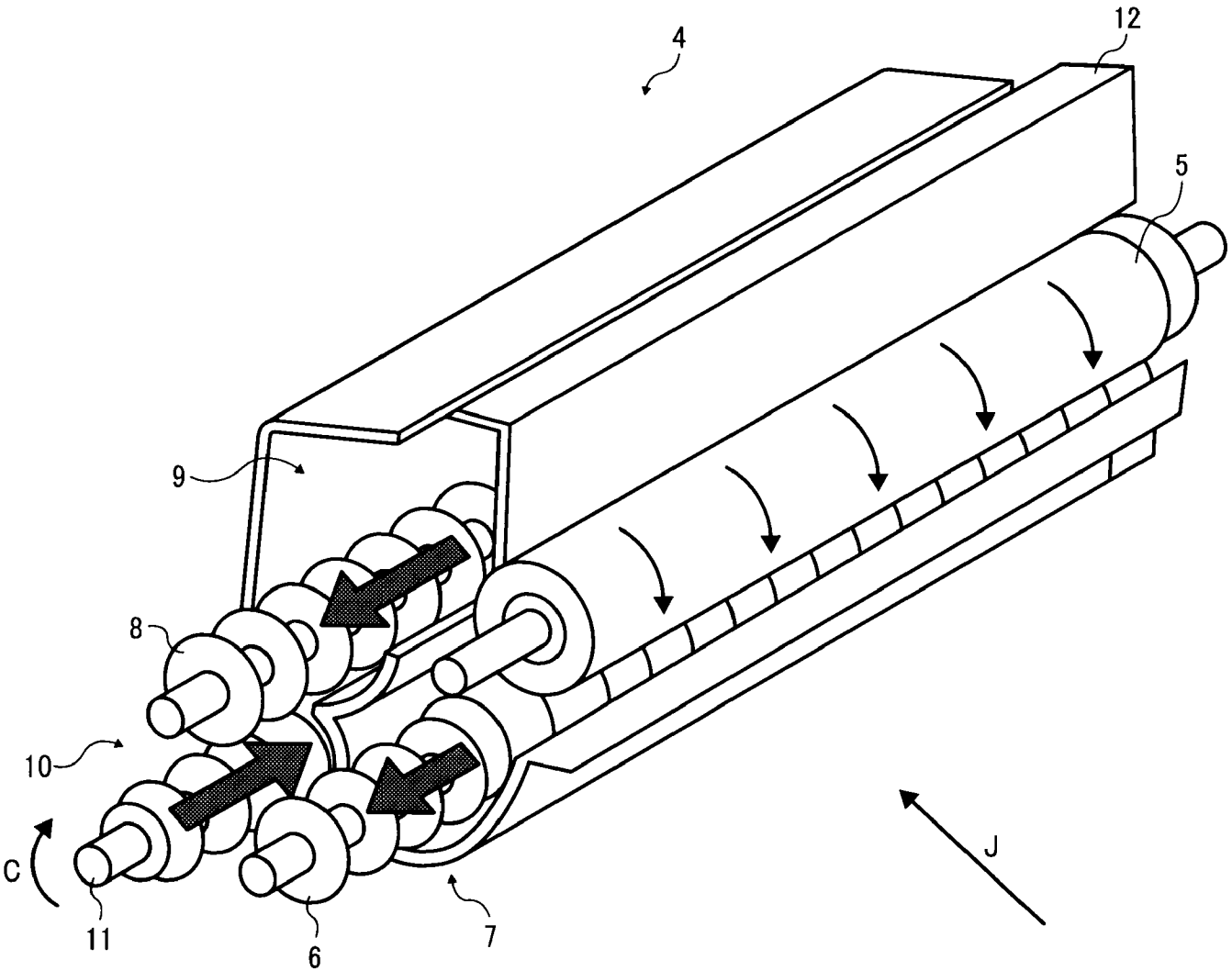
FIG. 4 is a cross-sectional perspective view illustrating the developing unit, according to an exemplary embodiment of the present invention.

As illustrated in FIG. 4, a supply path 9 equipped with the supply screw 8 is provided to the side of the developing roller 5. A recovery path 7 equipped with the recovery screw 6 serves as a conveyance path for collecting the developer and is provided substantially below the developing roller 5.

As illustrated in FIG. 4, the developing unit 4 further includes an agitation path 10. The agitation path 10 is provided substantially below the supply path 9 and aligned with the developer recovery path 7. The agitation path 10 is equipped with an agitation screw 11 serving as an agitation member configured to transport the developer in a direction opposite that of the action of the supply screw 8 while agitating the developer.

The supply path 9 and the agitation path 10 are divided by a first separator 133 serving as a separation wall. The separator 133 leaves both the front and the rear ends of the supply path 9 and the agitation path 10 open in FIG. 3, thereby allowing the supply path 9 and the agitation path 10 to communicate with each other.

It is to be noted that the supply path 9 and the recovery path 7 are also divided by the first separator 133. However, the first separator 133 leaves no opening between the supply path 9 and the recovery path 7.

The agitation path 10 and the recovery path 7 are divided by a second separator 134 serving as a separation wall. The second separator 134 leaves the front side in FIG. 3 of the agitation path 10 and the recovery path 7 open, thereby allowing the agitation path 10 and the recovery path 7 to communicate with each other.

The supply screw 8 serving as the developer transporter, the recovery screw 6, and the agitation screw 11 are formed of a resin or metal screw. A screw diameter of each of the screws is approximately ϕ22 mm. The supply screw 8 is of a double-row type having a screw pitch of approximately 50 mm. The recovery screw 6 and the agitation screw 11 are of a single-row type having a screw pitch of approximately 25 mm. A rotation speed of the supply screw 8 is set to approximately 690 rpm. The rotation speeds of the recovery screw 6 and the agitation screw 11 are set to approximately 730 rpm.

The doctor blade 12 is formed of stainless steel and regulates the developer on the developing roller 5 so as to form a thin layer. Development is performed such that the thin-layered developer is transported to the developing region facing the photoreceptor 1.

The surface of the developing roller 5 includes V-shape grooves, or is sandblasted. The developing roller 5 is formed of an Al or SUS tube having a diameter of approximately ϕ25 mm. The gap between the doctor blade 12 and the photoreceptor 1 is approximately 0.3 mm.

After development, the developer is collected in the recovery path 7 and transported to the front in FIG. 3 and is transferred to the agitation path 10 at the opening of the second separator 134 provided to the non-image area outside the developer bearing region on the developing roller 5.

It is to be noted that the developer is supplied to the agitation path 10 from a developer supply opening 95. The developer supply opening 95 is provided in the vicinity of the opening of the second separator 134 at the upstream end of the agitation path 10 in the direction of developer transport, at the upper side of the agitation path 10.

Next, a description will be given of circulation of the developer in the three-path developer conveyance system including the recovery path 7, the supply path 9, and the agitation path 10.

FIG. 4 is a cross-sectional perspective view illustrating the developing unit 4 for explaining directions of travel of the developer in the developing unit 4. Arrows in FIG. 4 indicate the direction of travel of the developer, respectively.

Figure 5:
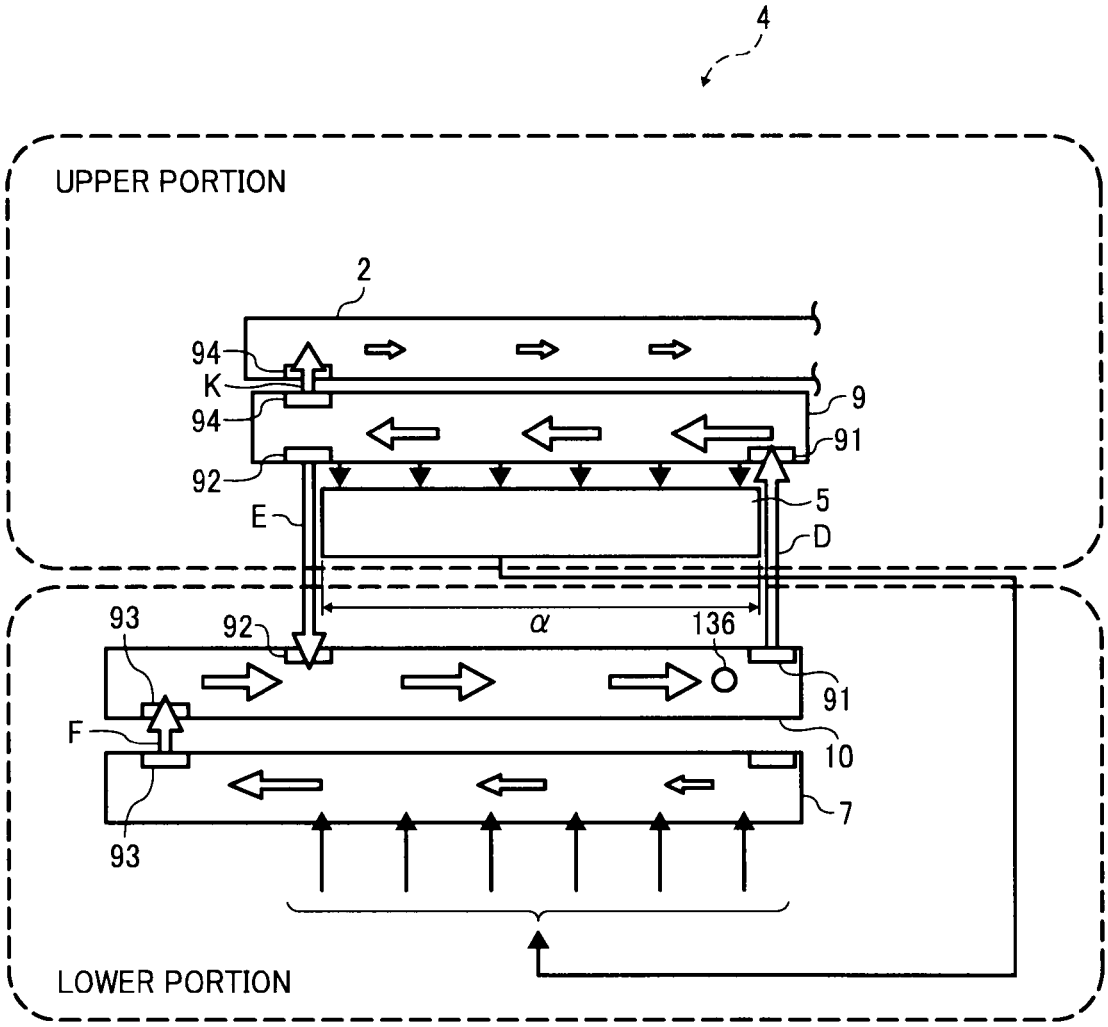
FIG. 5 is a conceptual diagram illustrating a direction of travel of the developer in the developing unit, according to an exemplary embodiment of the present invention.

FIG. 5 is a conceptual diagram illustrating the directions of travel of the developer in the developing unit 4. Similar to FIG. 4, arrows indicate the direction of travel of the developer.

The supply path 9 supplied with the developer from the agitation path 10 transports the developer to the vicinity of the downstream end of the supply path 9 using the supply screw 8 in the direction of developer transport while supplying the developer to the developing roller 5.

An excess developer, which is the developer supplied to the developing roller 5 but which has not been used in development, is transported in the vicinity of the downstream end of the supply path 9 in the transporting direction and supplied to the agitation path 10 from an opening 92 of the first separator 133 (indicated by an arrow E in FIG. 5.)

It is to be noted that the position in the vicinity of the downstream end of the supply path 9 in the direction of developer transport is a position (hereinafter referred to as an excess developer transfer position) where the excess developer is transferred from the agitation path 10

The collected developer fed from the developing roller 5 to the recovery path 7 and transported in the vicinity of the downstream end of the recovery path 7 in the direction of developer transport by the recovery screw 6 is supplied to the agitation path 10 from a recovery opening 93 of the second separator 134 (indicated by an arrow F in FIG. 5.)

It is to be noted that the position in the vicinity of the downstream end of the recovery path 7 is substantially the same position as the place where the collected developer is transferred to the agitation path 10.

The excess developer and the collected developer supplied from the recovery path 7 are agitated and mixed in the agitation path 10. The agitation screw 11 transports the mixed developer in the vicinity of the downstream end of the agitation path 10, which is the equivalent of the upstream end of the supply path 9. Subsequently, the mixed developer is supplied to the supply path 9 from an opening 91 of the first separator 133 (indicated by an arrow D in FIG. 5.) It is to be noted that the position in the vicinity of the downstream end of the agitation path 10 in the direction of developer transport and the position in the vicinity of the upstream end of the supply path 9 is a position (hereinafter referred to as a mixed developer transfer portion) where the mixed developer is transferred from the agitation path 10 to the supply path 9.

In the agitation path 10, the agitation screw 11 agitates and directs the collected developer, the excess developer, and the toner supplied from the developer supply opening 95 as necessary, in a direction opposite the direction of travel of the developer in the recovery path 7 and the supply path 9. Subsequently, the mixed developer is transferred to the vicinity of the upstream end of the supply path 9 communicating the vicinity of the downstream end of the agitation path 10 in the direction of developer transport.

It is to be noted that a toner density sensor 136 is provided in the vicinity of the downstream end of the agitation path 10 substantially below the developer supply opening 91 in the direction of developer transport. The sensor 136 enables a later-described developer supply controller serving as a developer supply device to regulate the supply of developer from the developer storage, not shown.

As will be described later, the developer is supplied from the developer supply opening 91 provided at the upper side of the agitation path 10 to the supply path 9 such that the developer accumulates in the vicinity of the downstream end of the agitation path 10 in the direction of developer transport. In other words, the developer is accumulated substantially below the supply opening 91 in the vicinity of the downstream end of the agitation path 10 in the direction of developer transport, and a certain amount of the developer stays in a firmly packed state at this position.

As a result, the developer at this position is less likely to be influenced by ambient conditions such as fluctuations in temperature and humidity that may affect permeability of the developer, or when the developing unit is not in operation. Therefore, the toner density sensor 136 is provided in the vicinity of the bottom of the developer supply opening 91 in the vicinity of the downstream end of the agitation path 10 so that the toner density of the developer can be detected accurately.

The developing unit 4 illustrated in FIG. 5 includes the supply path 9 and the recovery path 7 so that the developer can be supplied and collected in different paths, thereby making it possible to prevent developer already developed from being mixed into the supply path 9. Accordingly, it is possible to prevent the toner density of the developer supplied to the developing roller 5 from being reduced in the downstream portion of the supply path 9 in the direction of developer transport compared to a conventional developing unit using a cyclic conveyance method using a two-shaft screw.

Further, the developing unit 4 includes the recovery path 7 and the agitation path 10 so that the developer can be collected and mixed in the different paths, thereby making it possible to prevent the developer already developed from falling off in the agitation path 10. Accordingly, well-mixed developer can be supplied to the supply path 9, thus making it possible to prevent inadequately mixed developer from being supplied to the supply path 9.

In such a manner, it is possible to reduce, if not prevent entirely, reduction of the toner density in the supply path 9 and inadequate mixing of the developer in the supply path 9, thereby making it possible to achieve consistent image density during development.

As illustrated in FIG. 5, the developer travels from the lower portion to the upper portion of the developing unit 4 in the direction indicated by arrow-D. When the agitation screw 11 rotates, thus pushing and raising the developer, the developer travels in the direction indicated by arrow D and is supplied to the supply path 9 substantially above the agitation path 10.

However, such movement of the developer may stress the developer to some extent, possibly shortening the useful life of the developer. When the developer is carried upward from substantially the bottom to the upper side, the developer may be stressed. As a result, a coating on the carrier in the developer may be abraded and/or the toner may firmly adhere to the carrier, making it difficult to maintain stable imaging quality.

In view of the above, in the developing unit 4 according to the exemplary embodiment, as illustrated in FIG. 3, the supply path 9 is provided substantially obliquely above the agitation path 10. When the supply path 9 is provided substantially obliquely above the agitation path 10, the stress caused by the developer traveling in the direction indicated by arrow-D can be reduced compared to a case in which the supply path 9 is provided vertically above the agitation path 10.

As illustrated in FIG. 3, the supply path 9 is provided substantially obliquely above the agitation path 10 so that the opening, through which the developer is supplied, can be positioned relatively lower than the case in which the supply path 9 is provided vertically above the agitation path 10.

By contrast, when the supply path 9 is provided vertically above the agitation path 10, the developer is carried upward by the pressure of the agitation screw 11 against gravity, stressing the developer. On the other hand, when the supply path 9 is provided substantially obliquely above the agitation path 10, the height of the developer supply opening is relatively low so that the developer can be carried upward in a less stressful manner for the developer.

Alternatively, a portion of the shaft of the screw 11, where the agitation path 10 and the supply path 9 communicate in the vicinity of the downstream end of the agitation path 10, may include a fin-shaped member. The fin member may be formed of a plate member having sides parallel to the shaft direction of the agitation screw 11 and sides perpendicular to the shaft direction of the agitation screw 11. When the fin member brings the developer upward, the developer can be transferred from the agitation path 10 to the supply path 9 more efficiently.

As illustrated in FIG. 3, in the developing unit 4, the supply path 9 and the agitation path 10 are disposed such that a center-to-center spacing A between the developing roller 5 and the supply path 9 is substantially less than a center-to-center spacing B between the developing roller 5 and the agitation path 10. Accordingly, the developer can be comfortably supplied from the supply path 9 to the developing roller 5, and the size of the developing unit can be reduced as well.

The agitation screw 11 rotates in the clockwise direction indicated by arrow C in FIG. 3, as viewed from the front in FIG. 3. The developer is carried upward in accordance with the shape of the agitation screw 11 and transported to the supply path 9. Accordingly, it is made possible to efficiently bring the developer upward and reduce the stress on the developer.

Figure 6:
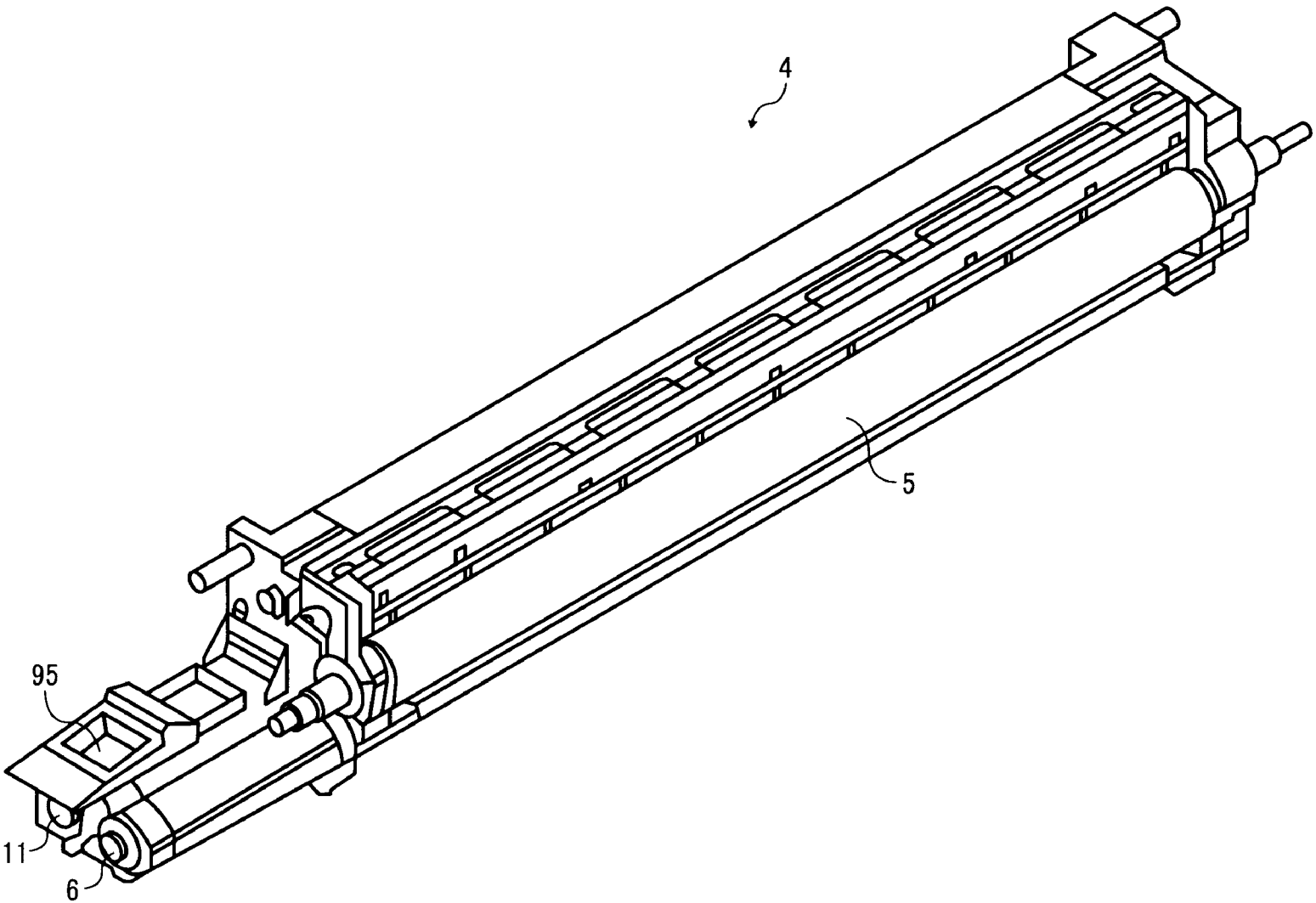
FIG. 6 is an external perspective view illustrating the developing unit, according to an exemplary embodiment of the present invention.

Next, a description is given of a position where the developer is supplied to the developer conveyance system in the developing unit 4. The developer conveyance system include the supply path 9, the agitation path 10, and the recovery path 7. FIG. 6 is an external perspective view illustrating the developing unit 4.

As illustrated in FIG. 6, the developer supply opening 95, through which the developer is supplied, is provided substantially above the upstream end portion of the agitation path 10 including the agitation screw 11 in the direction of developer transport.

The position of the developer supply opening 95 is not limited to the position described above, however, and alternatively the developer supply opening 95 may be provided substantially above the downstream end portion of the recovery path 7.

Further, alternatively, the developer supply opening 95 may be provided substantially above the recovery opening 93 where the developer is transferred from the recovery path 7 to the agitation path 10.

Figure 16:
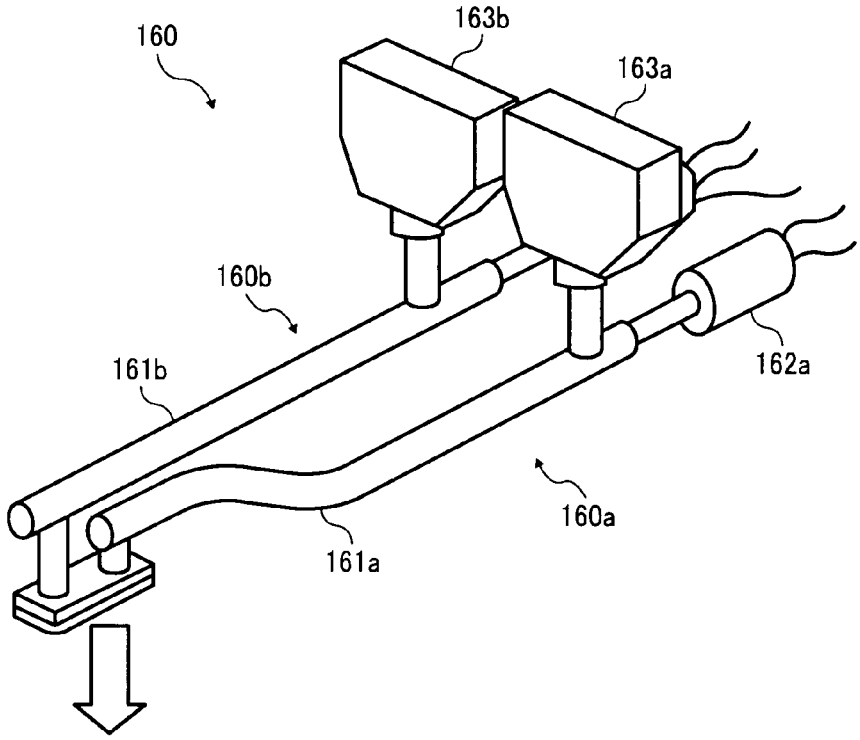
FIG. 16 is a perspective view illustrating a developer supply controller for independently supplying a toner and a carrier, according to an exemplary embodiment of the present invention.

Next, a description is given of a replacing operation of the developer in the developing unit 4. Referring now to FIG. 16, there is provided a schematic diagram illustrating the developer supply controller 160 serving as the developer supply device.

In FIG. 16, the developer supply controller 160 includes a toner supply device 160*a* and a carrier supply device 160*b*.

The toner supply device 160*a* includes a toner supply pipe 161*a* equipped with a toner conveyance screw inside thereof, not shown, a toner conveyance motor 162*a* that rotatively drives the toner conveyance screw, and a toner cartridge 163*a* that stores the toner.

One end of the toner supply pipe 161*a* is connected to the developer supply opening 95. The other end of the toner supply pipe 161*a* is provided with the toner conveyance motor 162*a*. The toner cartridge 163*a* is connected to the toner supply pipe 161*a*.

The carrier supply device 160*b* includes a carrier supply pipe 161*b* equipped with a carrier conveyance screw, not shown, inside thereof, a carrier conveyance motor, not shown, that rotatively drives the carrier conveyance screw, and a carrier cartridge 163*b* that stores the carrier.

Alternatively, the carrier cartridge 163*b* may store the developer consisting of the carrier mixed with a relatively small amount of the toner. One end of the carrier supply pipe 161*b* is connected to the developer supply opening 95. The other end of the carrier supply pipe 161*b* is provided with the carrier conveyance motor, not shown. The carrier cartridge 163*b* is connected to the carrier supply pipe 161*b*.

The toner conveyance motor 162*a* is controlled by a controller, not shown. The toner supplied from the toner cartridge 163*a* to the toner supply pipe 161*a* is transported to the developer supply opening 95 by the conveyance screw, thereby supplying a predetermined amount of the new toner to the developing unit 4.

Similarly, the carrier conveyance motor, not shown, is controlled by a controller, not shown. The carrier supplied from the carrier cartridge 163*b* to the carrier supply pipe 161*b* is transported to the developer supply opening 95 by the conveyance screw, thereby supplying a predetermined amount of a new carrier to the developing unit 4.

Alternatively, the carrier cartridge 163*b* may supply the carrier to the developing units 4Y, 4M, 4C, and 4K. In such a case, the carrier cartridge 163*b* is connected to each of carrier supply pipes 161*b*Y, 161*b*M, 161*b*C, and 161*b*K, for yellow, magenta, cyan and black, respectively. The carrier supply pipe 161*b*Y is connected to a developer supply opening 95Y of the developing unit for yellow, for example.

Similarly, the carrier supply pipe 161*b*M is connected to a developer supply opening 95M of the developing unit for magenta. The carrier supply pipe 161*b*C is connected to a developer supply opening 95C of the developing unit for cyan. The carrier supply pipe 161*b*K is connected to a developer supply opening 95K of the developing unit for black.

In the developer supply controller 160 as illustrated in FIG. 16, the toner and the carrier are supplied independently to the developer supply opening 95 by the toner supply device 160*a* and the carrier supply device 160*b*, respectively.

Alternatively, a premixed toner in which the toner and the carrier are pre-mixed may be supplied to the developer supply opening 95.

Figure 17:
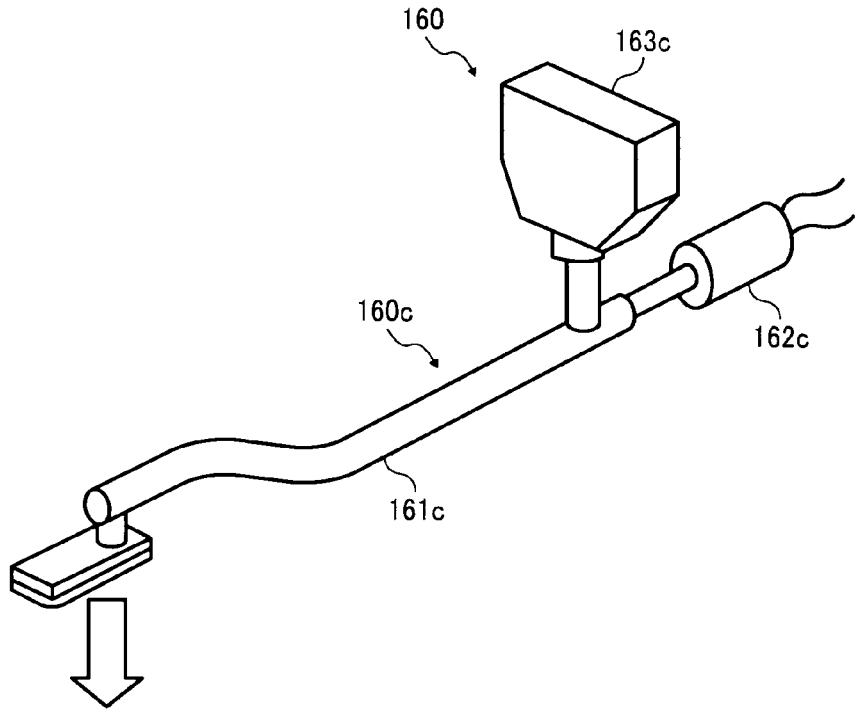
FIG. 17 is a perspective view illustrating a developer supply controller for independently supplying a premixed toner, according to an exemplary embodiment of the present invention.

Referring now to FIG. 17, there is provided a schematic diagram illustrating a premixed-developer supply controller 160*c*. The premixed-developer supply controller 160*c* supplies a premixed toner to the developer supply opening 95. The configuration of the premixed developer supply controller 160*c* is similar to, if not the same as, that of the toner supply device 160*a* and the carrier supply device 160*b*, except that the premixed developer supply controller 160*c* transports the premixed developer.

It is to be noted that the developer supply controller 160 described above includes the conveyance screw in the conveyance pipe and transports the toner, the carrier, the premixed toner, and so forth, to the developer supply opening 95 by the conveyance screw rotated by the motor. Alternatively, however, the developer supply controller 160 may include a powder pump to transport the toner, the carrier, the premixed toner, and so forth.

The supply path 9 includes a developer discharge device that discharges an excess developer in the supply path 9 to the outside of the developing unit 4, when the amount of the developer in the developing unit 4 reaches a certain amount as the premixed toner or the like is supplied.

The developer discharge device includes a developer discharge vent 94 and a discharge path 2 including a discharge screw 2*a* that transports the developer discharged from the discharge vent 94 to the outside of the developing unit 4.

The discharge path 2 is provided next to the supply path 9 between which a separator 135 is provided. The developer discharge vent 94 is an opening provided to the separator 135 to connect the supply path 9 and the discharge path 2 at the downstream end of the supply path 9 in the direction of developer transport.

According to the exemplary embodiment, a width of the opening of the developer discharge vent 94 is approximately 39 mm from the rear end in the direction of developer transport. It is to be noted, however, that the opening is not limited to the configuration described above. Alternatively, the opening may be provided such that excess developer created in a manner to be described later can be discharged outside the discharge path 2 from the developer discharge vent 94.

Next, a description is given of the developing unit 4 including the developer discharge vent 94.

Referring now to FIG. 1, there is provided a cross-sectional view illustrating the vicinity of the downstream end of the supply path 9 of the developing unit 4 in the direction of developer transport as viewed from the same direction as that of FIG. 3.

The position in the vicinity of the downstream end of the supply path 9 refers to, for example, substantially the same position as the developer transfer portion where the excess developer is transferred from the supply path 9 to the agitation path 10 in the direction of developer transport of the supply path 9.

According to the exemplary embodiment, in FIG. 3 the supply screw 8 in the supply path 9 rotates in a clockwise direction indicated by arrow M relative to the direction of developer transport of the supply screw 8. That is, the supply screw 8 rotates in a direction carrying the developer upward from the bottom relative to the developing roller 5.

By contrast, when the developer is supplied to the developing roller 5 such that the supply screw 8 rotates in the counterclockwise direction and the developer is dispersed over the developing roller 5, the developer is supplied to the developing roller 5 while being dispersed in air.

When the supply screw 8 rotates in the clockwise direction relative to the direction of developer transport as illustrated in FIG. 3, the developing roller 5 can be supplied with the developer such that the developer is carried upward from substantially the bottom of the supply path 9 where the developer is accumulated.

Therefore, rather than supplying the developing roller 5 with the developer by dispersing the developer over the developing roller 5, the developer can be supplied consistently when is carried upward from the bottom and supplied to the developing roller 5. Thus, in the developing unit 4, the supply screw 8 is configured to rotate in the clockwise direction relative to the direction of developer transport as illustrated in FIG. 3.

According to the exemplary embodiment, in the developing unit 4, the developer supplied to the developing roller 5 is not recovered to the supply path 9, but recovered to the recovery path 7. In particular, in such a structure, the amount of the developer gradually declines in the downstream portion of the supply path 9. Therefore, when the developer accumulated at the bottom is carried upward and supplied to the developing roller 5, the developer is supplied efficiently.

The momentum of the developer traveling in the supply path 9 and the torque of the supply screw 8 serving as the conveyance screw may cause the developer in the supply path 9 to leap. When the developer is forced to leap, it is possible that such excess developer may be discharged outside inadvertently, even if the amount of the developer traveling at the place where the developer discharge vent 94 in the supply path 9 is provided is appropriate and/or less than an appropriate amount.

Even if the amount of the developer in the developing unit 4 is less than the appropriate amount, when the excess developer is discharged inadvertently from the developer discharge vent 94 as described above, the amount of the developer in the developing unit 4 falls under a predetermined amount or a necessary amount, thereby supplying the photoreceptor 1 with an inconsistent amount of the developer.

Further, when the developer is inconsistently supplied to the photoreceptor 1, uneven images, for example, an image with blank portions, may be produced.

Figure 7:
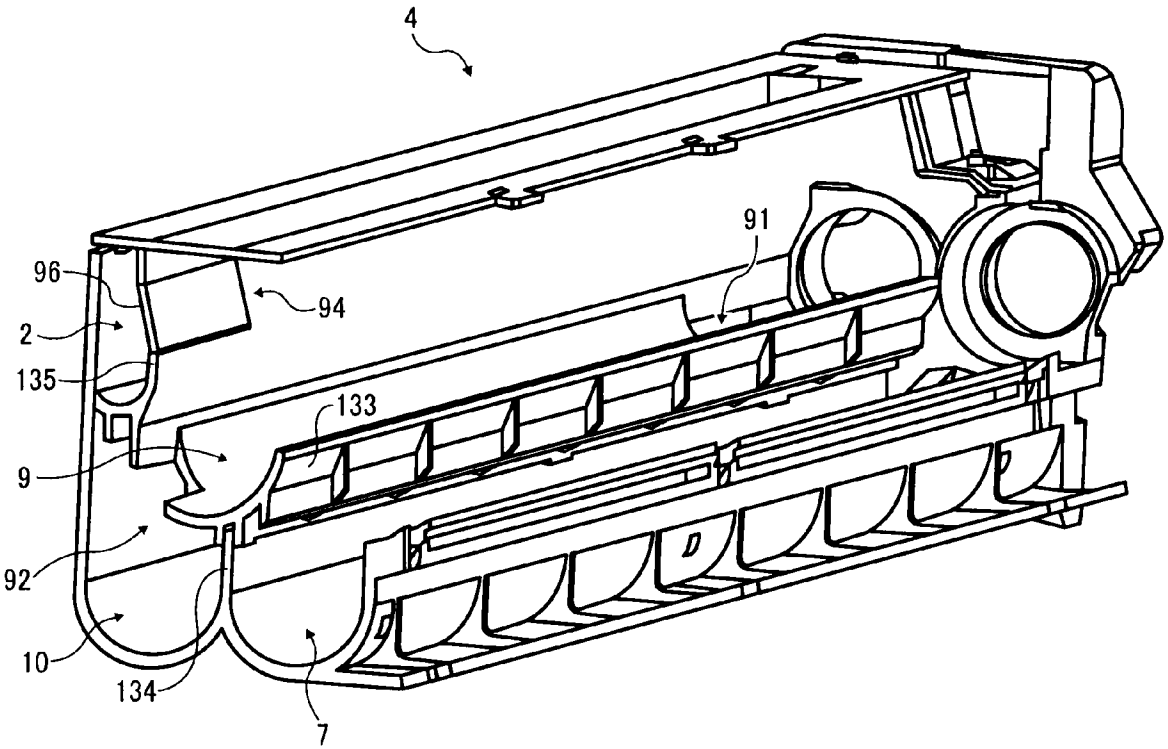
FIG. 7 is a cross-sectional perspective view illustrating the developing unit including a shutter member, according to an exemplary embodiment of the present invention.
Figure 8:
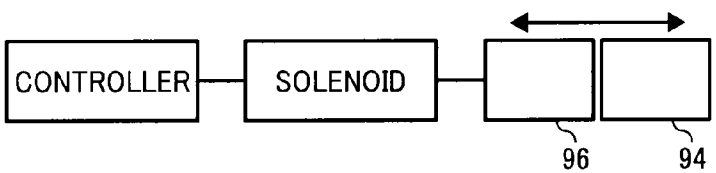
FIG. 8 is a block diagram illustrating a control mechanism for opening and closing of the shutter member of FIG. 7, according to an exemplary embodiment of the present invention.
Figure 9:
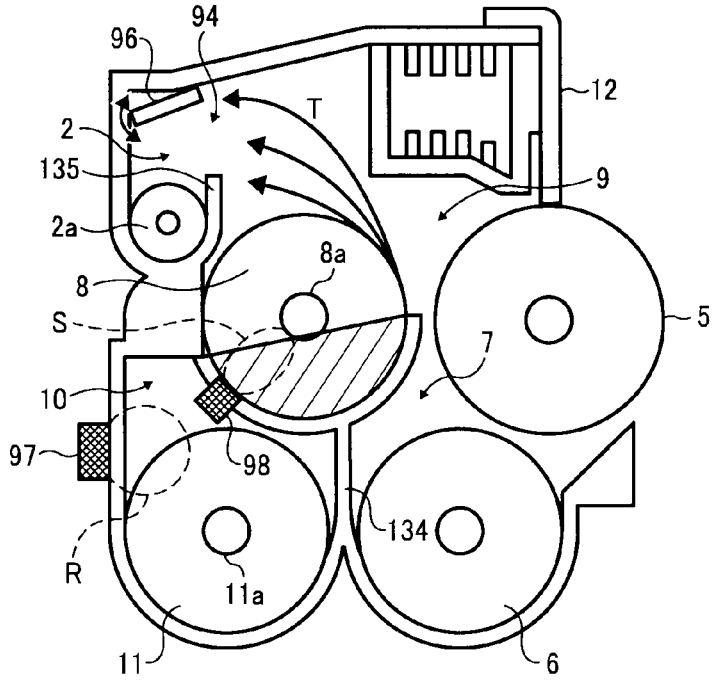
FIG. 9 is a cross-sectional view illustrating the developing unit when the shutter is opened, according to an exemplary embodiment of the present invention.

In view of the above, according to the exemplary embodiment, a shutter 96 is provided to the developer discharge vent 94 as illustrated in FIG. 7, which is a cross-sectional perspective view illustrating the developing unit including the shutter 96. The shutter 96 is configured to alternately block and open the developer discharge vent 94 that communicates the discharge path 2 to the supply path 9. As illustrated in FIG. 8, which is a block diagram illustrating a control mechanism for opening and closing of the shutter 96, when the developer needs to be discharged, a controller transmits a signal so as to enable a solenoid to open the shutter 96, thereby opening the developer discharge vent 94 as illustrated in FIG. 9.

Figure 10:
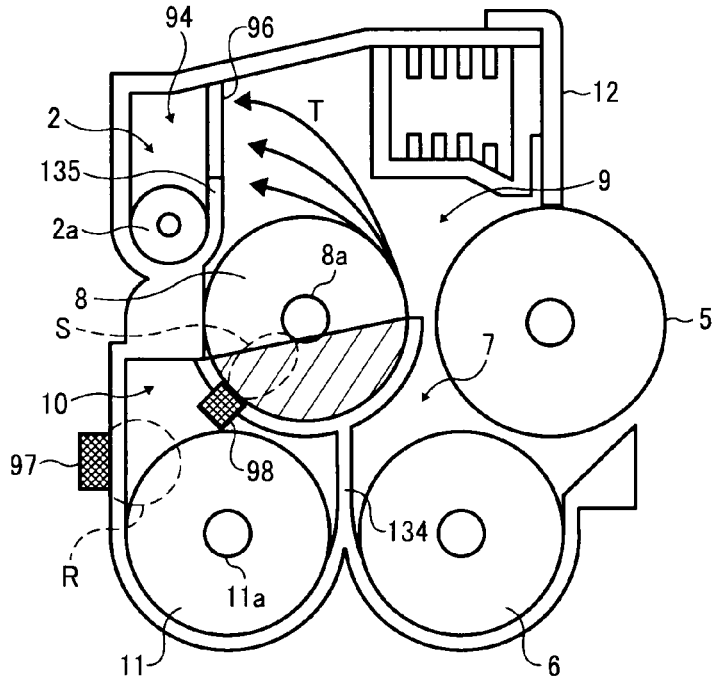
FIG. 10 is a cross-sectional view illustrating the developing unit when the shutter is closed, according to an exemplary embodiment of the present invention.

When, on the other hand, the developer does not need to be discharged, the controller transmits a signal so as to enable the solenoid to close the shutter 96, thereby blocking the developer discharge vent 94 as illustrated in FIG. 10.

Accordingly, it is made possible to reduce, if not prevent entirely, a problem in which the developer is discharged inadvertently from the developer discharge vent 94 even though the amount of the developer in the developing unit 4 is equal to or less than an appropriate amount. When such a problem is reduced or prevented, the photoreceptor 1 can be supplied consistently with the developer.

Further, according to this configuration, it is possible to prevent the newly supplied developer from being transported to the developer discharge vent 94 and being discharged before the newly supplied developer is mixed adequately with the preexisting developer in the developing unit. This means that the amount of the new developer being discharged can be reduced, thereby preventing waste.

It is to be noted that the method of opening and closing the shutter 96 is not limited to the method illustrated in FIGS. 9 and 10. Consequently, for example, the shutter 96 may be configured to slide vertically or horizontally.

According to the exemplary embodiment described above, the controller controls opening and closing of the shutter 96 based on a detection result provided by developer detectors 97 and 98 illustrated in FIGS. 9 and 10.

Figure 18:
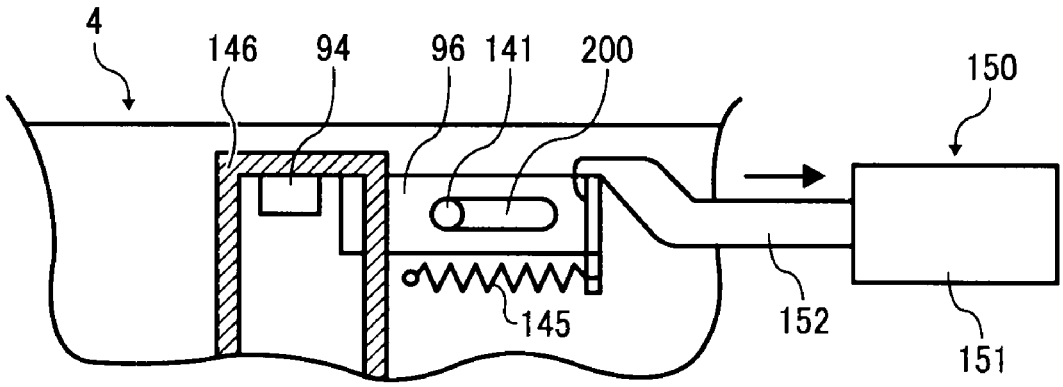
FIG. 18 is a side view illustrating a developer discharge vent when the shutter is opened, according to an exemplary embodiment of the present invention.

Referring to now to FIG. 18, there is provided a side view illustrating the developer discharge vent 94 when the shutter 96 is opened. As illustrated in FIG. 18, the shutter 96 includes a slot 200 formed in a horizontal direction. A guide pin 141 which projects from the side wall of the developing unit 4 is inserted in the slot 200 of the shutter 96. The shutter 96 is horizontally slidable in the slot 200 in FIG. 18.

A solenoid 150 serving as a shutter driving mechanism is provided to substantially the right of the shutter 96 in FIG. 18. The solenoid 150 includes a solenoid main body 151 and a drive shaft 152, the tip of which is hooked at the end portion of the shutter 96.

The drive shaft 152 is drawn inside the solenoid main body 151 in the direction indicated by an arrow according to excitation, thereby causing the shutter 96 to slidably move from the left to the right in FIG. 18. As illustrated in FIG. 18, the shutter 96 is drawn from the position facing the developer discharge vent 94 to the right, thereby opening the developer discharge vent 94.

As illustrated in FIG. 18, a coil spring 145 is fixedly provided to the shutter 96 such that the coil spring 145 biases the shutter 96 from the right to the left.

Figure 19:
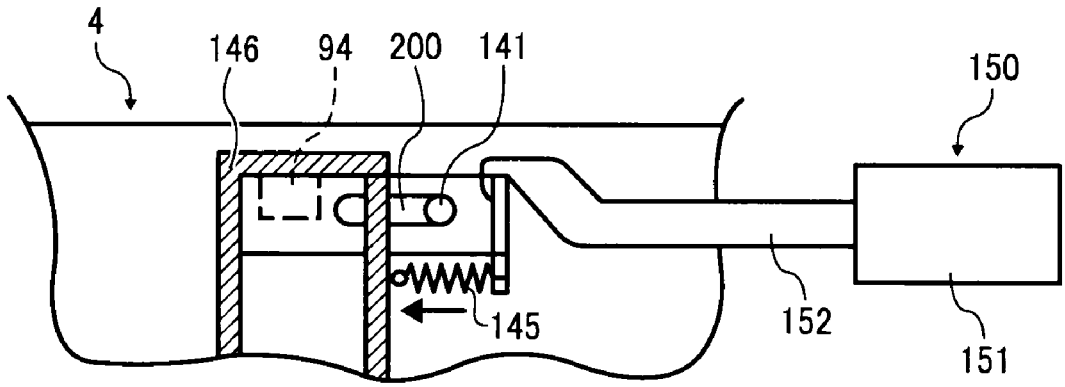
FIG. 19 is a side view illustrating the developer discharge vent when the shutter is closed, according to an exemplary embodiment of the present invention.

When an operation of the solenoid 150 is halted, as illustrated in FIG. 19, the shutter 96 is slidably moved laterally right to left due to retraction of the coil spring 145, thereby closing the developer discharge vent 94.

Based on the detection result provided by the developer detector 97 illustrated in FIGS. 9 and 10, the controller controls the operation of the shutter.

Figure 11:
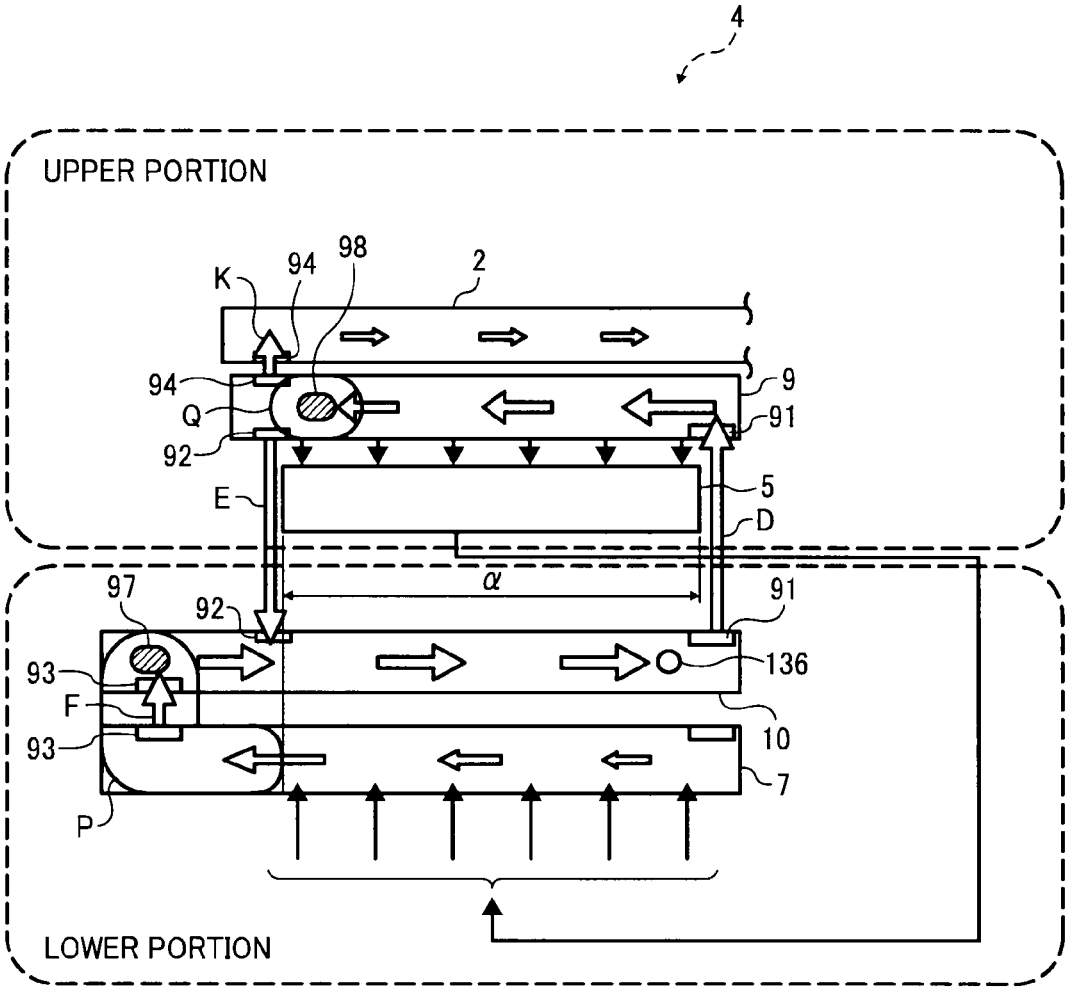
FIG. 11 is a schematic diagram illustrating a position of developer detectors in the developing unit, according to an exemplary embodiment of the present invention.

Referring now to FIG. 11, there is provided a mounting position of the developer detectors 97 and 98 serving as the developer detecting mechanism.

The developer detectors 97 and 98 are piezoelectric oscillation sensors provided to a region P and a region Q, respectively. In FIG. 11, the region P refers to an area from the downstream end of the recovery path 7 facing the developing roller 5 in the direction of developer transport to a developer receiving portion of the agitation path 10 where the agitation path 10 receives the collected developer from the recovery path 7. The region Q refers to the downstream end of the supply path 9 facing the developing roller 5 in the direction of developer transport.

According to the exemplary embodiment, the developer detectors 97 and 98 are piezoelectric oscillation sensors. Alternatively, however, the developer detectors 97 and 98 may use other developer detection methods, such as detecting magnetic permeability.

As illustrated in FIGS. 9 and 10, the developer detector 97, provided in the region P (reference to FIG. 11) and serving as the developer detecting mechanism for detecting rise of the developer, is provided substantially above the shaft 11*a* of the agitation screw 11, thereby detecting the developer in a region R indicated by a dotted circle.

That is, when the amount of the developer in the agitation path 10 increases and thus the level of the developer in the region P rises to the region R, the developer detector 97 detects the developer and outputs an output signal of 5V. It is to be noted that the output signal is not limited to 5V as long as the output signal does not adversely affect an electronic circuit.

By contrast, when the level of the developer in the region P decreases below the region R indicated by the dotted circle, the developer detector 97 fails to detect the developer.

Accordingly, the developer detector 97 detects whether or not the level of the developer is greater than or equal to the predetermined level in the region P, thereby detecting the rise of the developer level in the region P.

The developer detector 97 is provided to the region P because the region P is a position where the developer is transported from the recovery path 7 to the agitation path 10 and also where clogging of the developer is most likely to occur among the developer paths at an early stage of operation due to the presence of excess developer.

When clogging of the developer becomes critical, raising the level of the developer in the recovery path 7 upstream of the region P, the developer contacts the bottom of the developing roller 5. A part of the developer contacting the developing roller is attracted to the developing roller 5 due to the magnetic force exerted by the developing roller 5.

Consequently, even if the toner density is relatively low, it is possible that the developer is transported to the developing nip again, causing unevenness in density. In an attempt to reduce, if not prevent entirely, such a problem, the developer detector 97 is provided in the region P.

The developer detector 98, provided in the region Q and serving as the developer detecting mechanism for detecting decrease of the developer, is provided to substantially below the shaft 8a of the supply screw 8, thereby detecting the developer in a region S indicated by a dotted circle.

That is, when the amount of the developer in the supply path 9 is in the region S, the developer detector 98 detects the developer and outputs an output signal of 5V.

By contrast, when the level of the developer in the region Q decreases, the developer detector 98 fails to detect the developer. In other words, the developer detector 98 detects whether or not the level of the developer is less than or equal to the predetermined level in the region Q.

Accordingly, the amount of the developer in the areas P and Q is detected by the developer detectors 97 and 98, respectively.

Opening and closing of the shutter 96, and an operation of the motor, not shown, which rotatively drives the discharge screw 2*a,* are controlled by sending the output (5V when detecting the developer, 0V when detecting no developer) of the developer detector 97 disposed in the region P to the controller.

When the developer detector 97 outputs 5V, that is, when the level of the developer in the region P is no less than the predetermined level, the shutter 96 is controlled so as to open the developer discharge vent 94, and the discharge screw 2*a* is rotatively driven.

As described above, the discharge screw 2*a* is driven to rotate when the output indicating the presence of the developer is output. Accordingly, there is no need to rotate the discharge screw 2*a,* when the developer is not discharged, thereby reducing unnecessary driving of the discharge screw 2*a* and thus conserving energy.

By contrast, the output of the developer detector 98 provided in the region Q is sent to the developer supply controller 160 illustrated in FIG. 16 so as to supply the toner and the carrier. Alternatively, as illustrated in FIG. 17, when using the premixed toner, the developer supply controller 160 may supply the premixed toner to the developer supply opening 95. Transmission of the output is performed in a manner as illustrated in the control diagram shown in FIG. 12. A detailed description thereof will be provided later.

In such a configuration in which the developer is dispersed and is discharged as excess, accordingly, as in the exemplary embodiment, it may be difficult to measure the amount of the developer discharged so that more developer than necessary may be inadvertently discharged.

In view of the above, in order to reduce, if not prevent entirely, inadvertent discharge of the developer, it is effective to use the developer detector 97 to regulate the amount of the developer to be discharged based on the detection result provided by the developer detector 97.

It is to be noted that the mounting location of the developer detector 97 is the region P because, in the developing unit 4 according to the exemplary embodiment, when the toner density is approximately 8% and the developer of greater than or equal to 600 g is supplied, the agitation screw 11 reaches its capacity limit for transport of the developer, and the developer starts to accumulate at the developer receiving portion of the agitation path 10 in the region P where the agitation path 10 receives the developer from the recovery path 7.

Further, when the amount of the developer increases, the accumulated developer may cause the part of the developer to reach upstream of the recovery path 7 and eventually reach the downstream end of the recovery path 7 facing the developing roller 5 in the direction of developer transport. When the level of the developer at the downstream end of the recovery path 7 facing the developing roller 5 rises to or above the predetermined level, the problem described above may occur. Exceptionally, the developer may overflow from a space between the developing roller 5 and the lower case.

Therefore, according to the exemplary embodiment, the developer detector 97 is provided such that when the developer in an amount of approximately 600 g is supplied to the developing unit 4, the developer detector 97 detects the presence of the developer in the region R as illustrated in FIGS. 9 and 10.

The mounting location of the developer detector 98 in the region Q is determined because, in the developing unit 4 according to the exemplary embodiment, when the toner density is approximately 8% and the amount of the developer falls under approximately 400 g, the amount of the developer decreases in the vicinity of the downstream end of the supply path 9 facing the developing roller 5 in the direction of developer transport. Consequently, the developer cannot be supplied sufficiently to the developing sleeve in the vicinity of the downstream end of the supply path 9. As a result, a desirable image density cannot be obtained in a certain area of the image corresponding to this location.

Therefore, according to the exemplary embodiment, the developer detector 98 is provided such that, when the amount of the developer falls under approximately 450 g in the developing unit 4, the developer detector 98 fails to detect the developer at the region S illustrated in FIGS. 9 and 10.

That is to say, by detecting the amount of the developer at the places such as the region P and the region Q where the problems are most likely to occur when the amount of the developer exceeds or falls under a predetermined amount, the problems described above can be prevented.

Figure 13:
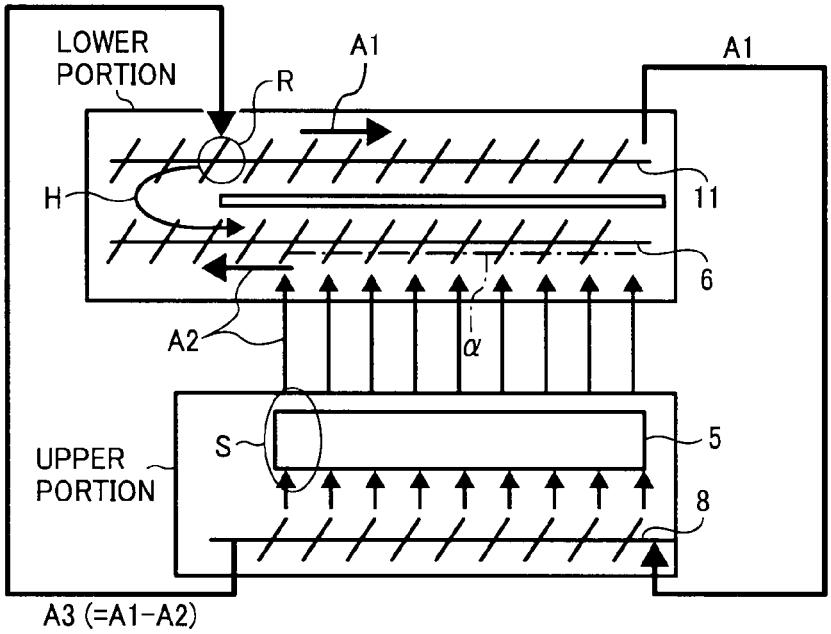
FIG. 13 is a conceptual diagram illustrating a generation mechanism of overflow of the developer in the developing unit, according to an exemplary embodiment of the present invention.

Referring now to FIG. 13, there is provided a schematic diagram illustrating the generating mechanism of overflow of the developer in the developing unit, based on an experiment using the developing unit 4 of the exemplary embodiment.

Figure 14:
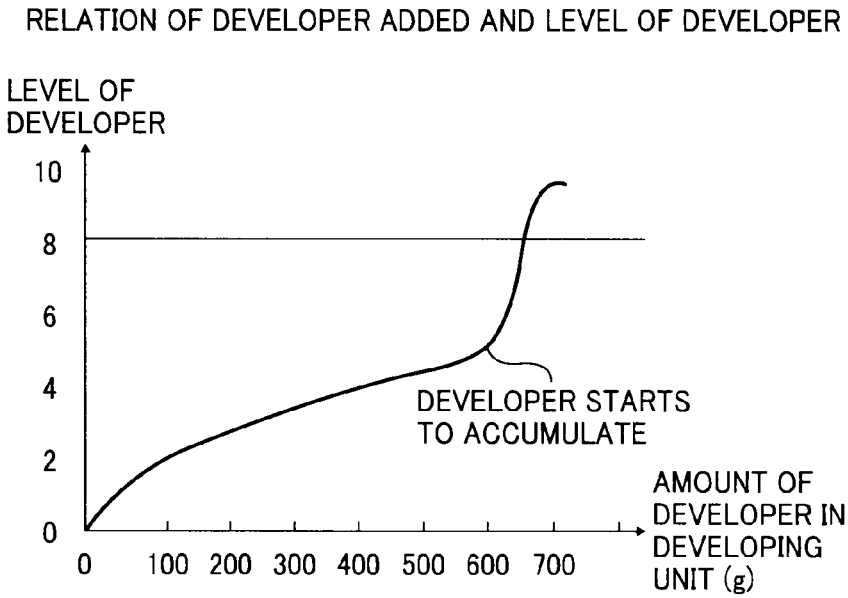
FIG. 14 is a graphic representation of a relation of an amount of the developer supplied and a level of the developer, according to an exemplary embodiment of the present invention.

When there is an excess amount of the developer at the place, particularly, the region R of FIG. 13, where the developer transported from the recovery path 7 to the agitation path 10 and the developer transported from the supply path 9 to the agitation path 10 merge, accumulation of the developer occurs at this place, thereby increasing the level of the developer at this place (Reference to FIG. 14.) As can be seen in FIG. 14, when the amount of the developer is greater than or equal to approximately 600 g, the developer starts to accumulate.

In FIG. 13, the region R refers to a place where the developer starts to accumulate and thus the level of the developer starts to rise. An arrow H refers to a direction of the accumulation of the developer or a moving direction of the rise of the level of the developer. Al refers to the developer on the agitation screw 11. A2 refers to the amount of the developer recovered.

Further, when the amount of the developer further increases, the accumulation area of the developer permeates further upstream, and thus due to accumulation of the developer, the level of the developer rises to an area of the recovery path 7 indicated by reference character a in FIG. 11. The area $\alpha$ corresponds to the area of the developing roller 5 (an area of the space between the developing roller 5 and the lower case.) When the level of the developer rises to the area $\alpha$, the developer overflows from the space between the developing roller 5 and the lower case.

Consequently, since the developer overflows in the manner described above, the developer detector 97 is provided to a position before the level of the developer reaches the area $\alpha$, according to the exemplary embodiment. In other words, the developer detector 97 is provided between the downstream end of the recovery path 7 facing the developing roller 5 and the developer receiving portion of the agitation path 10 so that the developer detector 97 detects the developer before the accumulated developer reaches the area a, and the output of the developer detector 97 is sent to the controller for discharging the developer before the accumulated developer reaches the region α.

Next, a description is given of deprivation of the developer on the developing roller 5.

The developer in the supply path 9 is transported downstream while being supplied to the developing roller 5. Thus, the amount of the developer at the downstream end of the supply path 9 facing the developing roller 5 in the direction of developer transport (the region S in FIG. 13) is less than that of the developer at the upstream of the supply path 9. The region S herein refers to a place where the depletion of the developer starts.

Therefore, when the amount of the developer in the supply path 9 is not sufficient, it is difficult to secure a sufficient amount of the developer to be supplied from the supply path 9 to the developing roller 5 at the downstream end of the supply path 9 facing the developing roller 5.

In the event that the developing roller 5 is not sufficiently supplied with the developer, the developer on the developing roller 5 is depleted. Consequently, the place of the developing roller 5 where the developer is depleted may have a problem, in that a desired image density cannot be achieved, for example.

According to the exemplary embodiment, as described above, the developer detector 97 is provided at the downstream end of the recovery path 7 in the transporting direction facing the developing roller 5 and the developer receiving portion of the agitation path 10. The output of the developer detector 97 is configured to be sent to the controller so as to turn ON/OFF the discharge screw 2*a*, and open and close the shutter 96.

Further, according to the exemplary embodiment, the developer detector 98 is provided in the vicinity of the downstream end of the supply path 9 facing the developing roller 5. Based on the detection result provided by the developer detector 98, the developer supply controller 160 serving as the developer supply mechanism is controlled.

As illustrated in FIG. 16, the developer supply controller 160 supplies the toner and the carrier independently. When the developer detector 98 sends its output to the developer supply controller 160, it is possible for the developer supply controller 160 to supply the developer, the toner density of which is similar to that of the developer in the developing unit. Accordingly, it is possible to prevent fluctuation of the developer when the developer is supplied.

Still further, as illustrated in FIG. 17, when the developer supply controller 160 is configured to supply the premixed toner including 10% carrier, the developer detector 98 sends its output to the developer supply controller 160 to supply the premixed toner.

Figure 12:
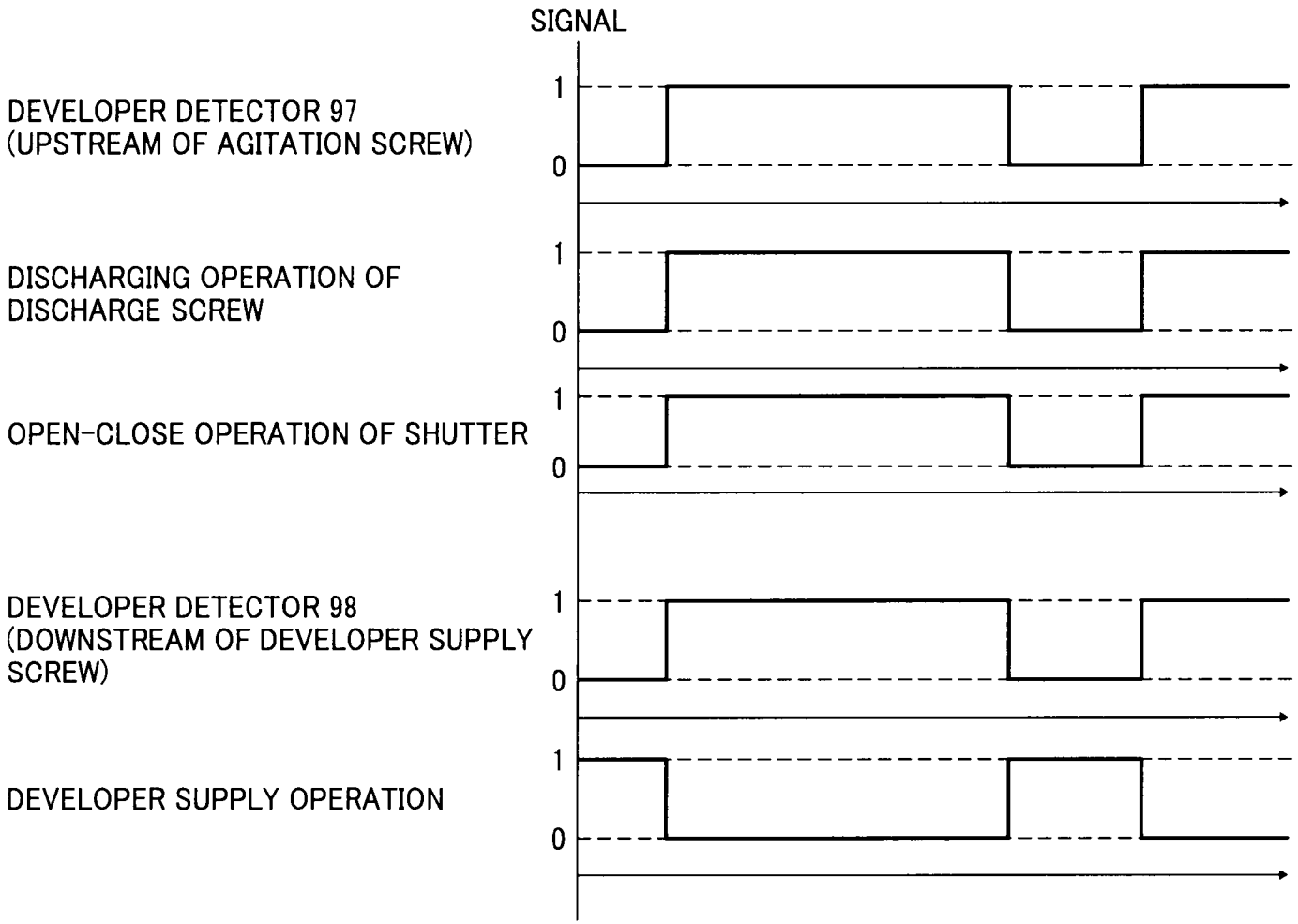
FIG. 12 is a timing chart illustrating output of the developer detectors of FIG. 11, according to an exemplary embodiment of the present invention.

Referring now to FIG. 12, there is provided a timing chart illustrating timing of output from the developer detectors 97 and 98.

As shown in FIG. 12, when the developer detector 98 detects the developer of greater than or equal to approximately 450 g in the developing unit 4 (Initial toner density of approximately 8%), the developer detector 98 outputs "1".

When the developer detector 98 fails to detect developer, the developer detector 98 outputs "0" and detects the toner density TC in the developing unit based on the output from the toner density sensor so as to control the developer supply controller 160 to achieve a target toner density which is similar to, if not the same as, the toner density in the developing unit 4.

The developer supply device 160 illustrated in FIG. 16 supplies the toner and the carrier independently. The developer supply device 160 sets the supply ratio of the toner and the carrier independently based on the output of the toner density sensor, and supplies the appropriate amount of the toner and the carrier to the developer supply opening 95, accordingly.

When the developer supply device 160 is configured to supply the premixed toner including approximately 10% carrier as illustrated in FIG. 17, the developer supply device 160 supplies the premixed toner such that the target toner density is achieved.

When the level of the developer is greater than or equal to 600 g in the developing unit 4 (initial toner density of approximately 8%), the developer detector 97 detects the developer and outputs "1", thereby enabling the shutter 96 of the developer discharge vent 94 to open so that the developer can be transported to the discharge path 2, and turning the discharge screw 2*a* ON (output:1) to discharge the developer.

Figure 15:
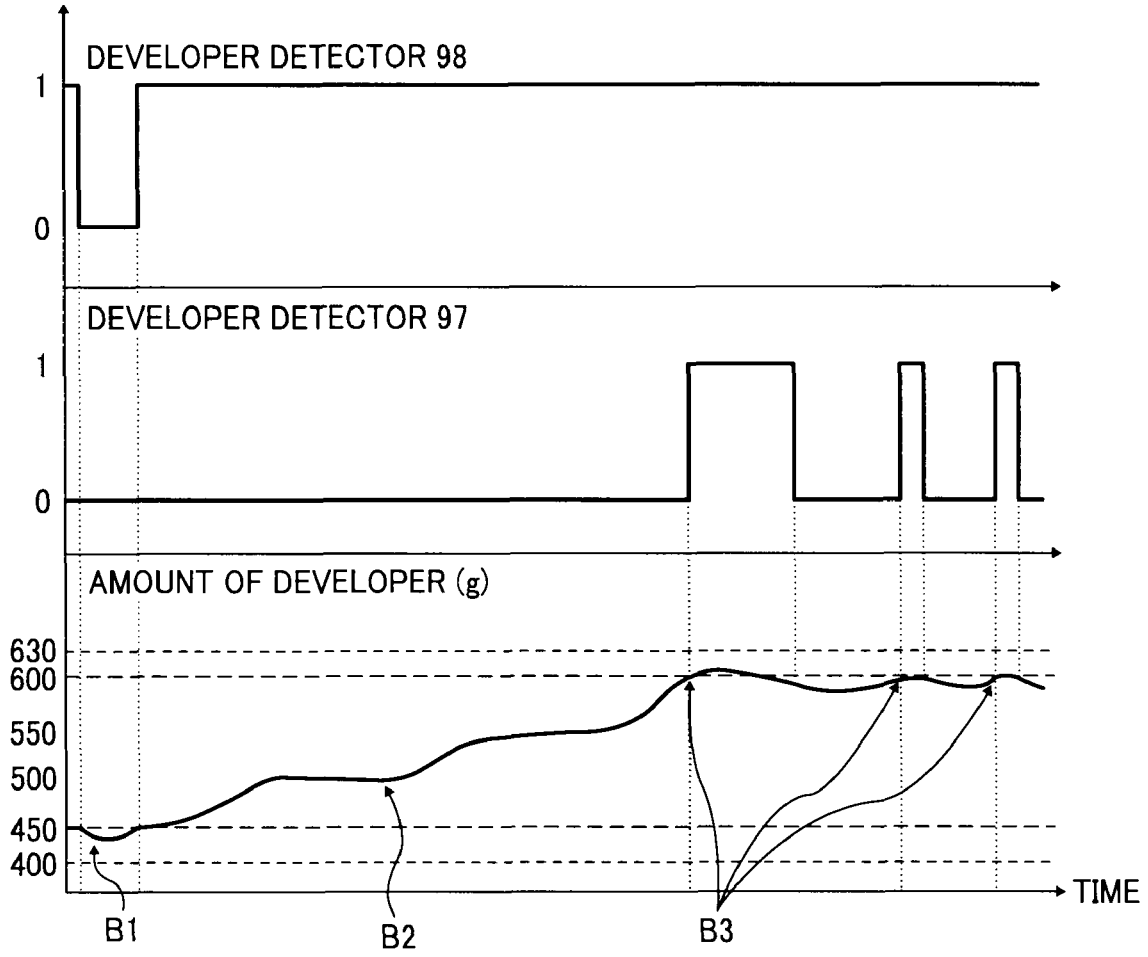
FIG. 15 is a graphic representation of a relation of output of the developer detectors and an amount of the developer in the developing unit, according to an exemplary embodiment of the present invention.

Referring now to FIG. 15, there is provided a diagram illustrating a relation between the output of the developer detectors 97 and 98, and the amount of the developer in the developing unit.

In FIG. 15, B1 indicates when the developer sensor 98 detects a decrease in the level of the developer, and thus the toner and the carrier are supplied so as not to change the toner density in the developing unit. B2 indicates the periodic toner supply. B3 indicates when the developer detector 97 detects a rise in the level of the developer and thus the developer starts to be discharged.

As illustrated in FIG. 15, the amount of the developer in the developing unit according to the exemplary embodiment is no less than 400 g which is an amount that causes depletion of the developer on the developing roller 5, and no more than 630 g which is an amount that causes overflow of the developer. Thus, according to the exemplary embodiment, a certain range of the amount of the developer causing no failure can be consistently maintained.

According to the exemplary embodiment, the developer detector 97 serving as a detector for detecting the rise of the developer is provided between the downstream end of the recovery path 7 and the developer receiving portion of the agitation path 10. Accordingly, the developer detector 97 can detect the rise of the level of the developer before the accumulated developer reaches the space between the lower case and the developing roller 5.

Accordingly, it is made possible to attain high detection sensitivity despite rapid increase in the level of the developer due to accumulation of the developer. Further, before the developer is accumulated and reaches the space between the opening of the lower case and the developing roller 5, the developer detector 97 can detect the presence of the developer, thereby preventing a problem such as overflow of the developer.

According to the exemplary embodiment, the developer detector 98 is provided in the vicinity of the downstream end of the supply path 9 facing the developing roller 5 so that the developer detector 98 can detect a decrease in the developer before the developer starts to deplete. Accordingly, it is made possible to prevent depletion of the developer in the vicinity of the downstream end of the supply path 9 facing the developing roller 5.

Still further, the developer supply controller 160 can supply the toner and the carrier independently and determine the supply ratio of the toner and the carrier based on the detection result provided by the toner density sensor. Accordingly, when the developer detector 98 fails to detect the developer, the developer having a similar if not the same toner density as that of the developer in the developing unit can be supplied so that the toner density in the developing unit remains the same regardless of the developer supplied, thereby making it possible to prevent fluctuation of the image density.

According to the exemplary embodiment, when the image forming apparatus, for example, a copier, is equipped with the developing unit 4, the developer can be discharged without clogging the developer discharge vent 94, thereby preventing the amount of the developer in the developing unit from increasing more than necessary. Accordingly, an appropriate amount of the developer can be supplied to the developing roller 5, and separation of the used developer from the developing roller 5 can be performed appropriately so that a desirable latent image can be developed on the photoreceptor 1.

It is to be noted that elements and/or features of different exemplary embodiments may be combined with each other and/or substituted for each other within the scope of this disclosure and appended claims.

The number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, the aforementioned methods may be embodied in the form of a system or device, including, but not limited to, any of the structure for performing the methodology illustrated in the drawings.

Example embodiments being thus described, it will be apparent that the same may be varied in many ways. Such exemplary variations are not to be regarded as a departure from the spirit and scope of the present invention, and all such modifications as would be obvious to one skilled in the art are intended to be included within the scope of the following claims.

What is claimed is:

1. A developing unit, comprising:

a developer bearing member provided across from a latent image bearing member, configured to bear a developer on a surface of the developer bearing member and supply a toner to a latent image on a surface of the latent image bearing member while rotating;

a developer transporter configured to convey the developer;

a developer conveyance system configured to direct the developer, the developer conveyance system including:

a supply path configured to direct the developer along an axial direction of the developer bearing member and supply the developer to the developer bearing member;

a recovery path configured to direct the developer collected from the developer bearing member along the axial direction of the developer bearing member after passing an area opposite the latent image carrier and in substantially the same direction as a transporting direction of the supply path;

an agitation path configured to:

receive excess developer not used in development and transported to a vicinity of a downstream end of the supply path in a direction of developer transport and collected developer transported to a vicinity of a downstream end of the recovery path in the direction of developer transport;

direct the excess developer and the collected developer along the axial direction of the developer bearing member and in a direction opposite that of the supply path while mixing the excess developer and the collected developer together; and supply the mixed developer to the supply path after mixing the excess developer and the collected developer together;

a developer supply opening through which the developer is supplied to the developer conveyance system;

a developer supply device configured to supply the developer from the developer supply opening to the developer conveyance system;

a developer discharge device configured to discharge the developer outside the developing unit;

a developer detector configured to detect an increase in a level of the developer between the downstream end of the recovery path facing the developer bearing member in the direction of developer transport and a portion of the agitation path where the agitation path receives the collected developer from the recovery path; and a controller configured to control the developer discharge device based on a detection result provided by the developer detector.

2. A developing unit, comprising:

a developer bearing member provided across from a latent image bearing member, configured to bear a developer on a surface of the developer bearing member and supply a toner to a latent image on a surface of the latent image bearing member while rotating;

a developer transporter configured to convey the developer;

a developer conveyance system configured to direct the developer, the developer conveyance system including:

a supply path configured to direct the developer along an axial direction of the developer bearing member and supply the developer to the developer bearing member;

a recovery path configured to direct the developer collected from the developer bearing member along the axial direction of the developer bearing member after passing an area opposite the latent image carrier and in substantially the same direction as a transporting direction of the supply path;

an agitation path configured to:

receive excess developer not used in development and transported to a vicinity of a downstream end of the supply path in a direction of developer transport and collected developer transported to a vicinity of a downstream end of the recovery path in the direction of developer transport;

direct the excess developer and the collected developer along the axial direction of the developer bearing member and in a direction opposite that of the supply path while mixing the excess developer and the collected developer together; and supply the mixed developer to the supply path after mixing the excess developer and the collected developer together;

a developer supply opening through which the developer is supplied to the developer conveyance system;

a developer supply device configured to supply the developer from the developer supply opening to the developer conveyance system;

a developer discharge device configured to discharge the developer outside the developing unit;

a developer detector configured to detect a decrease in a level of the developer substantially near the downstream end of the supply path facing the developer bearing member in the direction of developer transport; and a controller configured to control the developer supply device based on a detection result provided by the developer detector.

3. The developing unit according to claim 1, further comprising an additional developer detector configured to detect a decrease in a level of the developer substantially near the downstream end of the supply path facing the developer bearing member in the direction of developer transport, wherein the controller is configured to control the developer supply device based on a detection result provided by the additional developer detector.

4. The developing unit according to claim 1, wherein the developer discharge device comprises a discharge screw configured to transport the developer outside the developing unit, and the controller is configured to turn ON and OFF the discharge screw based on the detection result provided by the developer detector.

5. The developing unit according to claim 1, wherein the developer discharge device further comprises a discharge path including the discharge screw, and a shutter member which alternately opens and blocks communication between the discharge path and the supply path, wherein the controller opens and closes the shutter member based on the detection result provided by the developer detector.

6. The developing unit according to claim 2, wherein the controller controls the developer supply device to start supplying the developer based on the detection result provided by the developer detector.

7. The developing unit according to claim 1, further comprising a toner density detector configured to detect a density of the toner in the developer in the developer conveyance system, wherein the developer supply device is configured to supply the toner and the carrier independently and determines a ratio of the toner and the carrier to supply based on a detection result provided by the toner density detector.

8. An image forming apparatus, comprising:

an image bearing member configured to bear a latent image on a surface thereof; and a developing unit including:

a developer bearing member provided across from a latent image bearing member including a latent image on a surface thereof, configured to bear developer on the surface of the developer bearing member while rotating and supply toner to the latent image on the surface of the latent image bearing member;

a developer transporter configured to convey the developer;

a developer conveyance system configured to direct the developer including:

a supply path configured to direct the developer along an axial direction of the developer bearing member and supply the developer to the developer bearing member;

a recovery path configured to direct the developer collected from the developer bearing member along an axial direction of the developer bearing member after passing an area opposite the latent image carrier and in substantially the same direction as a transporting direction of the supply path;

an agitation path configured to:

receive excess developer not used in development and transported to a vicinity of a downstream end of the supply path in a direction of developer transport and collected developer transported to a vicinity of a downstream end of the recovery path in the direction of developer transport;

direct the excess developer and the collected developer along the axial direction of the developer bearing member and in a direction opposite that of the supply path while mixing the excess developer and the collected developer together; and supply a mixed developer to the supply path after mixing the excess developer and the collected developer together;

a developer supply opening through which the developer is supplied to the developer conveyance system;

a developer supply device configured to supply the developer from the developer supply opening to the developer conveyance system;

a developer discharge device configured to discharge the developer outside the developing unit;

a developer detector configured to detect an increase in a level of the developer between the downstream end of the recovery path facing the developer bearing member in the direction of developer transport and a portion of the agitation path where the agitation path receives the collected developer from the recovery path; and a controller configured to control the developer discharge device based on a detection result provided by the developer detector.

9. A process cartridge detachably mountable in an image forming apparatus, comprising:

an image bearing member integrally included in the process cartridge, configured to bear a latent image on a surface thereof; and the developing unit of claim 1.

10. The developing unit according to claim 1, wherein the agitation path is arranged adjacent and parallel to the supply path and the recovery path.

11. The developing unit according to claim 2, wherein the agitation path is arranged adjacent and parallel to the supply path and the recovery path.

12. The image forming apparatus according to claim 8, wherein the agitation path is arranged adjacent and parallel to the supply path and the recovery path.

13. The developing unit according to claim 1, wherein the recovery path is fluidly connected to the agitation path at a downstream end of the recovery path and the supply path is fluidly connected to the agitation path at a downstream end of the supply path.

14. The developing unit according to claim 2, wherein the recovery path is fluidly connected to the agitation path at the downstream end of the recovery path and the supply path is fluidly connected to the agitation path at a downstream end of the supply path.

15. The image forming apparatus according to claim 8, wherein the recovery path is fluidly connected to the agitation path at the downstream end of the recovery path and the supply path is fluidly connected to the agitation path at the downstream end of the supply path.

* * * * *